US012716404B2

(12) United States Patent
Liu et al.

(10) Patent No.: US 12,716,404 B2
(45) Date of Patent: Aug. 25, 2026

(54) AXIAL PISTON PUMPS

(71) Applicant: ZHONG MOYUAN TECHNOLOGY (SHANGHAI) CO., LTD., Shanghai (CN)

(72) Inventors: Panpan Liu, Xuzhou (CN); Zhu Gao, Suzhou (CN)

(73) Assignee: ZHONG MOYUAN TECHNOLOGY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 19/394,841

(22) Filed: Nov. 19, 2025

(65) Prior Publication Data

US 2026/0071620 A1 Mar. 12, 2026

Related U.S. Application Data

(63) Continuation-in-part of application No. PCT/CN2025/116647, filed on Aug. 25, 2025.

(30) Foreign Application Priority Data

Jul. 5, 2024 (CN) ..... 202410896402.8

(51) Int. Cl.
*F04B 1/2028* (2020.01)
*F04B 1/126* (2020.01)
*F04B 1/2071* (2020.01)

(52) U.S. Cl.
CPC ..... *F04B 1/2028* (2013.01); *F04B 1/126* (2013.01); *F04B 1/2071* (2013.01)

(58) Field of Classification Search
CPC ..... F04B 51/00; F04B 1/124; F04B 1/146; F04B 1/2014; F04B 1/2035; F04B 1/2078;

(Continued)

(56) References Cited

U.S. PATENT DOCUMENTS 3,208,395 A * 9/1965 Budzich ..... F04B 1/306 384/100
4,916,901 A 4/1990 Hayashi et al.
(Continued)

FOREIGN PATENT DOCUMENTS

CN 2619066 Y 6/2004
CN 108238664 A 7/2018
(Continued)

OTHER PUBLICATIONS

Notification to Grant Patent Right for Invention in Chinese Application No. 202410896402.8 mailed on Oct. 11, 2024, 5 pages.
(Continued)

*Primary Examiner* — Nathan C Zollinger
(74) *Attorney, Agent, or Firm* — PORUS IP LLC

(57) ABSTRACT

Provided is an axial piston pump. The axial piston pump includes a pump housing assembly, a base plate, an inlet and outlet flange, and a transmission shaft. The base plate is located at a bottom of the pump housing assembly, and the inlet and outlet flange is located at a top of the pump housing assembly. The pump housing assembly, the base plate, and the inlet and outlet flange enclose an inner chamber. A piston cylinder assembly, a piston and piston forced return assembly, and a swash plate assembly are arranged in the inner chamber. The transmission shaft passes through the inlet and outlet flange and is connected to the piston cylinder assembly.

15 Claims, 18 Drawing Sheets

(58) Field of Classification Search
CPC .... F04B 1/2085; F04B 1/2071; F04B 1/2028; F04B 1/126
See application file for complete search history.

(56) References Cited

U.S. PATENT DOCUMENTS

| | | | | |
|---|---|---|---|---|
| 7,188,562 | B2 * | 3/2007 | Hansen | F04B 1/124 92/71 |
| 9,909,420 | B2 * | 3/2018 | Andersen | F04B 1/12 |
| 9,932,828 | B2 * | 4/2018 | Iversen | F01B 3/0023 |
| 10,309,380 | B2 * | 6/2019 | MacHarg | F04B 1/2078 |
| 2002/0187055 | A1 * | 12/2002 | Nelson | F04B 1/30 91/499 |
| 2016/0281505 | A1 * | 9/2016 | MacHarg | F04B 1/2035 |

FOREIGN PATENT DOCUMENTS

| | | | | |
|---|---|---|---|---|
| CN | 110067720 | A | 7/2019 | |
| CN | 111810374 | A | 10/2020 | |
| CN | 111828278 | A | 10/2020 | |
| CN | 114060245 | A | 2/2022 | |
| CN | 217518798 | U | 9/2022 | |
| CN | 118442275 | A | 8/2024 | |
| DE | 2124645 | A1 | 11/1972 | |
| GB | 901268 | A | 7/1962 | |
| WO | WO-0034653 | A2 * | 6/2000 | F04B 1/122 |

OTHER PUBLICATIONS

International Search Report in PCT/CN2025/116647 mailed on Nov. 24, 2025, 7 pages.
Written Opinion in PCT/CN2025/116647 mailed on Nov. 24, 2025, 7 pages.

* cited by examiner

AXIAL PISTON PUMPS

CROSS-REFERENCE TO RELATED APPLICATIONS

This application is a continuation-in-part application of International Application No. PCT/CN2025/116647 filed on Aug. 25, 2025, which claims priority to Chinese Patent Application No. 202410896402.8 filed on Jul. 5, 2024, the entire contents of each of which are hereby incorporated by reference.

TECHNICAL FIELD

The present disclosure relates to the technical field of piston pumps, and in particular to an axial piston pump.

BACKGROUND

A piston pump is a crucial component in hydraulic fluid systems. The piston pump operates by the reciprocating motion of pistons within the cylinder body, altering volume of a sealed working chamber to achieve water suction or water pressurization. The piston pump offers advantages such as high rated pressure, compact structure, high efficiency, convenient flow regulation, etc.

An axial piston pump is a piston pump in which a reciprocating direction of pistons is parallel to a center axis of a cylinder. The axial piston pump operates by utilizing volumetric changes generated by the reciprocating motion of the pistons parallel to a transmission shaft within piston bores. Since both the pistons and the piston holes are circular components, the pistons and the piston holes can achieve high precision fit, resulting in high volumetric efficiency.

At present, the axial piston pump exhibits following limitations:

(1) At present, bearing support structures mostly adopts hydrodynamic support, life of a bearing is low, and the bearing cannot withstand axial force, thus causing damage to the pump under axial force. A piston cylinder runs relying on hydrodynamic support, which requires a high rotational speed. If the rotational speed is too low, the bearing support structures will cause failure of the hydrodynamic support of the piston cylinder, or even tilting of the piston cylinder, which in turn causes failure of the piston return stroke, resulting in irreversible damage to the piston pump. The bearing support structures impose significant operational constraints on the axial piston pump. Improper installation or maintenance may readily cause severe irreversible damage, deterring potential users.

(2) The piston pump uses a combination of stainless steel and poly-ether-ether-ketone (PEEK) plastic as a friction partner, which has a very poor tolerance to particles in a plurality of application environments, causing rather strict requirements for application environment of the piston pump. For example, media feed water needs to be filtered through a filter element with an absolute accuracy of 5 μm. However, the friction pair still exhibits poor tolerance to a plurality of material particles. Currently, the piston pump is only applied in seawater desalination and ultrapure water cleaning. In other fluid applications, the piston pump exhibits poor performance, with lifespans reaching only about 30% of rated service life.

(3) The existing piston forced return structure adopts a center spring return. Spring failure will cause the piston pump to malfunction. Similarly, the piston pump will fail when the axial force exists.

Therefore, an axial piston pump structure is proposed to overcome aforementioned shortcomings.

SUMMARY

One or more embodiments of the present disclosure provide an axial piston pump. The axial piston pump comprises a pump housing assembly, a base plate, an inlet and outlet flange, and a transmission shaft, wherein the base plate is located at a bottom of the pump housing assembly, the inlet and outlet flange is located at a top of the pump housing assembly, the pump housing assembly, the base plate, and the inlet and outlet flange enclose an inner chamber configured to accommodate other structures of the axial piston pump, the inner chamber is provided with a piston cylinder assembly, a piston and piston forced return assembly, and a swash plate assembly, and the transmission shaft passes through the inlet and outlet flange and is connected to the piston cylinder assembly, wherein the piston and piston forced return assembly includes a piston assembly and a forced return mechanism, the piston assembly includes a ceramic piston and a ceramic slipper combined together, and the forced return mechanism includes a return plate, a spherical hinge, a return guide column, and preload springs; the ceramic slipper is connected to the return plate and is supported on a swash surface of the swash plate assembly; a plane of the spherical hinge and the return plate form a plane friction pair, and a spherical surface of the spherical hinge is hinged to a spherical socket of the return guide column; the return guide column is installed in a return guide sleeve of the piston cylinder assembly, a side of the return guide column opposite to the spherical socket is provided with a plurality of spring holes for installing the preload springs, and ends of the preload springs protrude from the spring holes and abut against the piston cylinder assembly.

The piston cylinder assembly includes a piston cylinder and a hydrostatic inner ring disposed on an outer side of the piston cylinder, the ceramic piston of the piston assembly is movably disposed in a piston sleeve of the piston cylinder, one end of the piston cylinder is drivingly connected to the transmission shaft, and a center hole at another end of the piston cylinder is provided with the return guide sleeve, and the return guide sleeve cooperates with the return guide column in the forced return mechanism to provide cooperative guiding.

The pump housing assembly includes a pump housing on an outer side and a hydrostatic outer ring on an inner side, and the hydrostatic outer ring and the hydrostatic inner ring are both made of a ceramic material and form a hydrostatic main bearing; the hydrostatic outer ring is supported on a support surface at an end of the hydrostatic inner ring, an outer cylindrical surface of the hydrostatic inner ring is provided with a hydrostatic pad, an outer cylindrical surface of the hydrostatic outer ring is provided with a high-pressure water annular groove, and the high-pressure water annular groove communicates with the hydrostatic pad through a hydrostatic main bearing pressure supply hole provided in the high-pressure water annular groove; and one end of the hydrostatic outer ring is provided with a hydrodynamic support friction surface, which frictionally contacts the support surface, and the hydrodynamic support friction surface is provided with a plurality of first Archimedean spiral convection grooves along a circumferential direction of the hydrodynamic support friction surface.

The hydrostatic pad of the hydrostatic inner ring has a wedge-shaped stepped structure, including a first hydrostatic water pad and two second hydrostatic water pads, one second hydrostatic water pad is disposed at each axial end of the first hydrostatic water pad, and the first hydrostatic water pad is lower than the two second hydrostatic water pads, forming a stepped structure; and the two second hydrostatic water pads each have a wedge-shaped structure, and a small diameter end of each of the two second hydrostatic water pads is connected to the first hydrostatic water pad.

The spherical socket of the return guide column is provided with a central through hole and an Archimedean spiral damping groove is arranged surrounding the central through hole; a bottom surface of the spherical hinge is provided with a convection damping hole penetrating through the spherical surface of the spherical hinge, the convection damping hole communicates with the central through hole, and a labyrinth hydrostatic support water pad is disposed surrounding the convection damping hole.

The piston assembly includes the ceramic piston and the ceramic slipper, a ball head of the ceramic piston is provided with a center hole and a ball head damping groove surrounding the center hole, and the ball head damping groove is an Archimedean spiral groove; and a center of an end surface of the ceramic slipper is provided with a slipper damping hole capable of communicating with the center hole, and a third hydrostatic water pad having a sealing band is disposed surrounding the slipper damping hole.

Two ends of the hydrostatic main bearing are respectively provided with a flow distribution and distribution sealing axial thrust bearing and an end axial bearing, wherein the flow distribution and distribution sealing axial thrust bearing is adjacent to the inlet and outlet flange, and the end axial bearing is located at a bottom of the axial piston pump and is disposed surrounding the swash plate assembly.

The flow distribution and distribution sealing axial thrust bearing includes a thrust plate guiding assembly, a thrust plate assembly, and a port plate assembly coaxially arranged in sequence; the thrust plate guiding assembly, the thrust plate assembly, and the port plate assembly all have annular disk-shaped structures, an outer side of a center hole of the thrust plate guiding assembly is coaxially provided with a pre-sealing thrust mechanism, the pre-sealing thrust mechanism is connected to an end surface of the piston cylinder of the piston cylinder assembly, and a guide member on the thrust plate guiding assembly is sealingly connected to the piston sleeve of the piston cylinder; and the flow distribution and distribution sealing axial thrust bearing is provided with a medium channel communicating with the piston sleeve.

The end axial bearing is cylindrical, including a polyether-ether-ketone (PEEK) collar and an alloy core embedded in the PEEK collar, an end surface of the PEEK collar facing the hydrostatic main bearing is provided with a composite surface, the composite surface contacts an inner ring friction surface of the hydrostatic inner ring, the composite surface includes a wedge-shaped surface, a bearing support surface, and a second Archimedean spiral convection groove connected in sequence, an angle of the wedge-shaped surface ranges from 1° to 2°, and a plurality of the composite surfaces are sequentially arranged along a circumferential direction on an end surface of the end axial bearing.

The pre-sealing thrust mechanism includes a thrust retaining ring and a plurality of thrust springs installed on a same side of the thrust retaining ring, the plurality of thrust springs are arranged at intervals along a circumferential direction of the thrust retaining ring, the thrust retaining ring is installed in an annular groove on an end surface of the piston cylinder assembly, and the annular groove is provided with thrust spring guide holes for accommodating the thrust springs.

The thrust plate assembly includes a thrust plate support ring and a thrust plate ceramic wear ring connected coaxially, an outer cylindrical surface of the thrust plate ceramic wear ring is assembled on an inner cylindrical surface of the thrust plate support ring, and the thrust plate support ring is a metal ring; and the thrust plate ceramic wear ring is provided with a plurality of valve holes at intervals along a circumferential direction.

The port plate assembly includes a port plate support ring and a port plate ceramic wear ring connected coaxially, the port plate support ring is a metal ring, an outer cylindrical surface of the port plate ceramic wear ring is assembled on an inner cylindrical surface of the port plate support ring, and the port plate ceramic wear ring is provided with a plurality of port plate orifices at intervals along a circumferential direction.

Through holes on the thrust plate guiding assembly, the port plate orifices on the port plate assembly, and the valve holes on the thrust plate assembly communicate to form the medium channel.

BRIEF DESCRIPTION OF THE DRAWINGS

The present disclosure will further illustrate by way of exemplary embodiments, which will be described in detail with reference to the accompanying drawings. Embodiments are not intended to be limiting, and identical reference numerals denote identical structures throughout.

REFERENCE NUMERALS IN THE DRAWINGS

Figure 1:
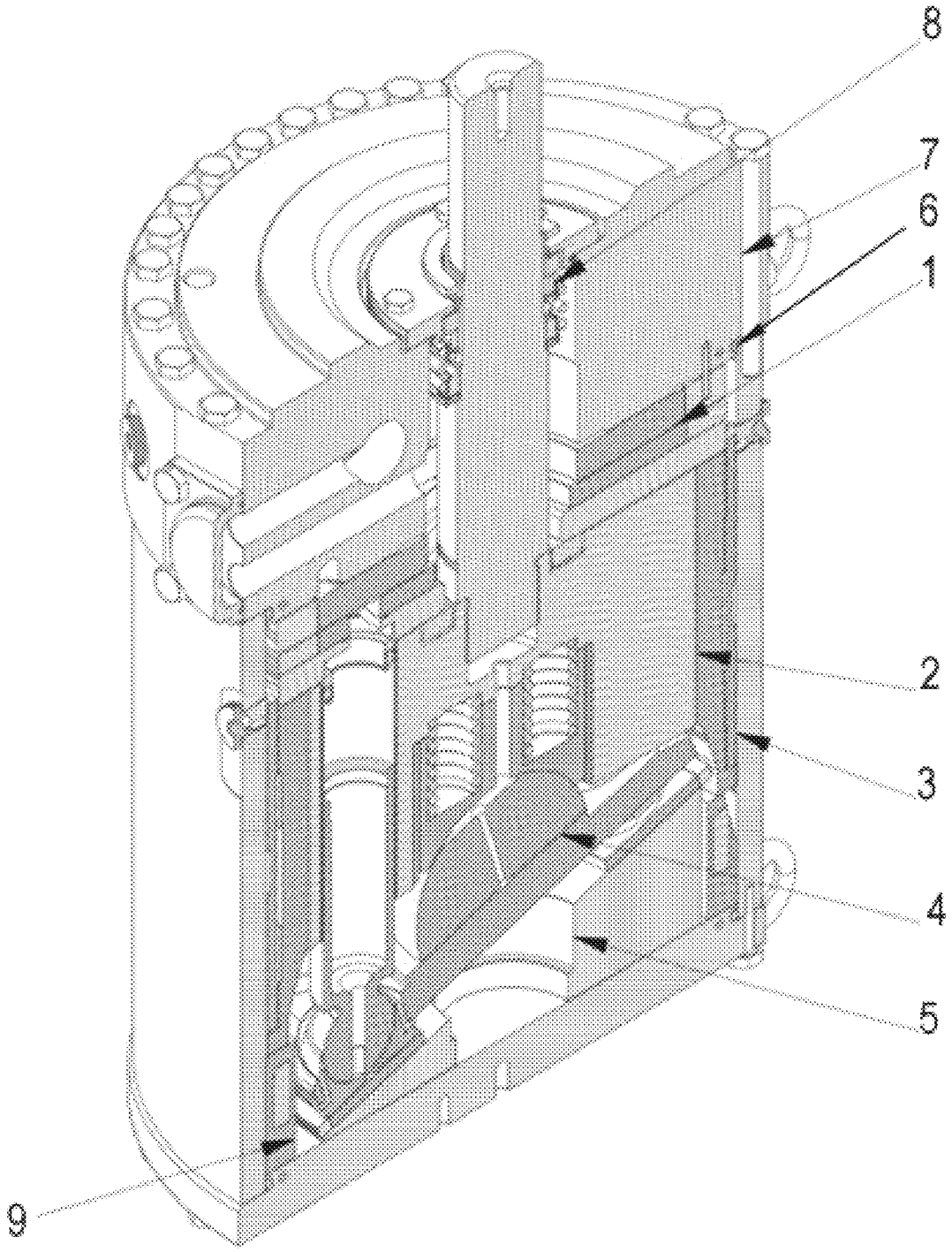
FIG. 1 is an axial sectional view illustrating an axial piston pump according to some embodiments of the present disclosure.

1—flow distribution and distribution sealing axial thrust bearing; 1.1—thrust plate guiding assembly; 1.1.1—bolt; 1.1.2—through hole seal; 1.1.3—guide member; 1.1.4—guide seal member; 1.2—pre-sealing thrust mechanism, 1.2.1—thrust retaining ring, 1.2.2—thrust spring; 1.3—thrust plate assembly, 1.3.1—thrust plate support ring, 1.3.2—thrust plate ceramic wear ring, 1.3.3—valve hole, 1.3.4—threaded hole; 1.4—port plate assembly, 1.4.1—port plate support ring, 1.4.2—port plate ceramic wear ring, 1.4.3—port plate orifice;

2—piston cylinder assembly, 2.1—hydrostatic inner ring, 2.1.1—inner ring friction surface; 2.1.2—hydrostatic pad, 2.1.2.1—first hydrostatic water pad, 2.1.2.2—second hydrostatic water pad, 2.1.3—hydrostatic inner ring support surface, 2.1.4—damping ring band; 2.2—piston cylinder; 2.3—return guide sleeve, 2.3.1—helical lubrication channel; 2.4—piston sleeve; 2.5—alloy insert sleeve; 2.5.1—thrust spring guide hole; 2.5.2—convection hole;

3—pump housing assembly, 3.1—hydrostatic outer ring, 3.1.1—high-pressure water annular groove, 3.1.2—hydrostatic main bearing pressure supply hole, 3.1.3—hydrodynamic support friction surface; 3.2—pump housing, 3.2.1—hydrostatic support high-pressure water plug hole, 3.2.2—pump housing convection pipe interface; 3.3—pump base convection pipe interface;

4—piston and piston forced return assembly, 4.1—ceramic piston, 4.1.1—piston ball head, 4.1.2—ball head damping groove; 4.2—return plate; 4.3—spherical hinge, 4.3.1—labyrinth hydrostatic support water pad, 4.3.2—convection damping hole; 4.4—return guide column, 4.4.1—spherical socket, 4.4.2—central through hole, 4.4.3—Archimedean spiral damping groove; 4.5—preload spring; 4.6 ceramic slipper, 4.6.1—slipper damping hole, 4.6.2—hydrostatic water pad with a sealing strip; 4.7—ceramic pressure sleeve; 4.8—ceramic ring; 4.9—metal buckle ring;

5—swash plate assembly, 5.1—swash plate; 5.2—friction plate, 5.2.1—ceramic inner ring, 5.2.2—metal outer ring;

6—damper;

7—inlet and outlet flange, 7.1—hydrostatic bearing high-pressure water supply port; 7.2—convection groove, 7.3—reinforcing rib; 7.4—water inlet; 7.5—water outlet; 7.6—flange convection pipeline interface;

8—transmission shaft;

9—end axial bearing, 9.1—PEEK ring, 9.1.1—wedge-shaped surface, 9.1.2—bearing support surface, 9.1.3—second Archimedean spiral convection groove; 9.2—alloy core.

DETAILED DESCRIPTION

To more clearly illustrate technical solutions of embodiments described in the present disclosure, the following provides a brief introduction to the drawings required for describing the embodiments. It is evident that drawings described below are merely examples or embodiments of the present disclosure. For those skilled in the art, it is possible to apply the present disclosure to other similar scenarios based on these drawings without requiring creative labor. Unless obviously obtained from the context or the context illustrates otherwise, the same numeral in the drawings refers to the same structure or operation.

In some embodiments, as shown in FIG. 1, an axial piston pump (hereinafter referred to as a piston pump) includes a pump housing assembly 3, a base plate, and an inlet and outlet flange 7. The base plate is located at a bottom of the pump housing assembly 3, and the inlet and outlet flange 7 is located at a top of the pump housing assembly 3. The pump housing assembly 3, the base plate, and the inlet and outlet flanges 7 enclose an inner chamber configured to house other components of the piston pump. Other structures of the piston pump may include a piston cylinder assembly, a piston and piston forced return assembly, and a swash plate assembly. The inner chamber provides sealing and support for all internal structures. A damper 6 is also arranged between the inlet and outlet flange 7 and the pump housing assembly 3. The damper 6 is a thin-walled small-hole damper, which can enhance damping effectiveness and improve stability.

In some embodiments, the inner chamber is provided with a flow distribution and distribution sealing axial thrust bearing 1, a piston cylinder assembly 2, a piston and piston forced return assembly 4, a swash plate assembly 5, and an end axial bearing 9. In some embodiments, a transmission shaft 8 passes through the inlet and outlet flange 7 and is connected to the piston cylinder assembly 2. When the transmission shaft 8 rotates under external power, the transmission shaft 8 drives the piston cylinder 2.2 to rotate.

The piston cylinder assembly 2 is configured to house the piston assembly for reciprocating motion. The piston and piston forced return assembly 4 enables a reciprocating motion of water suction and water pressurization by the piston, while providing reliable forced return force under adverse external conditions.

Figure 3:
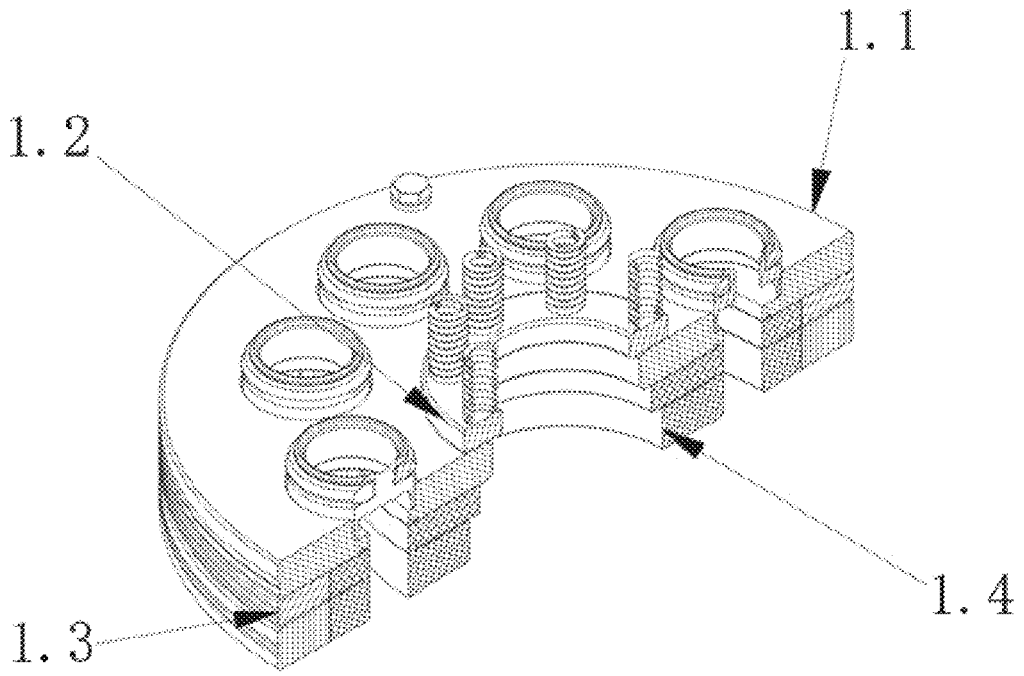
FIG. 3 is a schematic diagram illustrating a structure of a flow distribution and distribution sealing axial thrust bearing according to some embodiments of the present disclosure.

In some embodiments, as shown in FIG. 3, the flow distribution and distribution sealing axial thrust bearing 1 includes a thrust plate guiding assembly 1.1, a thrust plate assembly 1.3, and a port plate assembly 1.4 arranged coaxially in sequence.

FIG. 3 shows an inverted structure of the flow distribution and distribution sealing axial thrust bearing 1 shown in FIG. 1. The thrust plate guiding assembly 1.1 is integrally of an annular plate structure and is located at a bottom of the flow distribution and distribution sealing axial thrust bearing 1. The port plate assembly 1.4 is integrally of an annular plate structure and is located at the top of the flow distribution and distribution sealing axial thrust bearing 1. The thrust plate assembly is integrally of an annular plate structure and is located between the port plate assembly 1.4 and the thrust plate guiding assembly 1.1. In some embodiments, a pre-sealing thrust mechanism 1.2 is coaxially arranged on an outer side of a central hole of the thrust plate guiding assembly 1.1. The pre-sealing thrust mechanism 1.2 is annular and located on a bottom surface of the thrust plate guiding assembly 1.1. The thrust plate guiding assembly 1.1, the pre-sealing thrust mechanism 1.2, the thrust plate assembly 1.3, and the port plate assembly 1.4 are all arranged coaxially. The thrust plate guiding assembly 1.1, the thrust plate assembly 1.3, and the port plate assembly 1.4 may be fixedly connected together using bolting, welding, or other connection manners.

In some embodiments, the pre-sealed thrust mechanism 1.2 is connected to an end surface of the piston cylinder 2.2 of the piston cylinder assembly 2, and the guide member 1.1.3 of the thrust plate guiding assembly 1.1 is hermetically connected to a piston sleeve 2.4 of the piston cylinder 2.2. The flow distribution and distribution sealing axial thrust bearing 1 is provided with a medium channel communicating with the piston sleeve 2.4.

Figure 4:
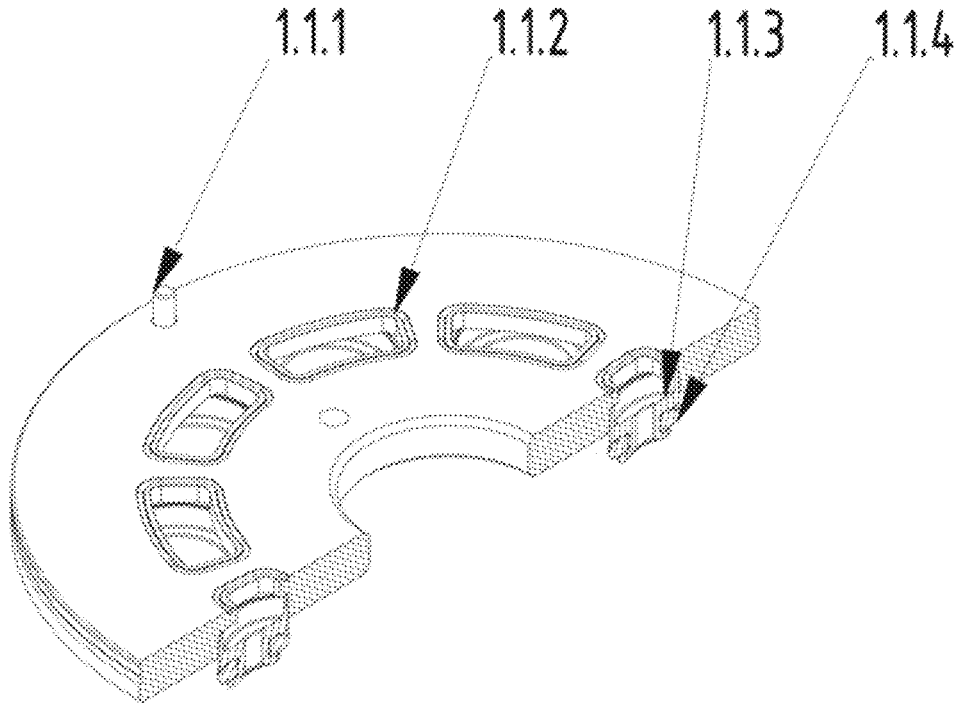
FIG. 4 is a schematic diagram illustrating a structure of a thrust plate guiding assembly shown in FIG. 3.
Figure 12:
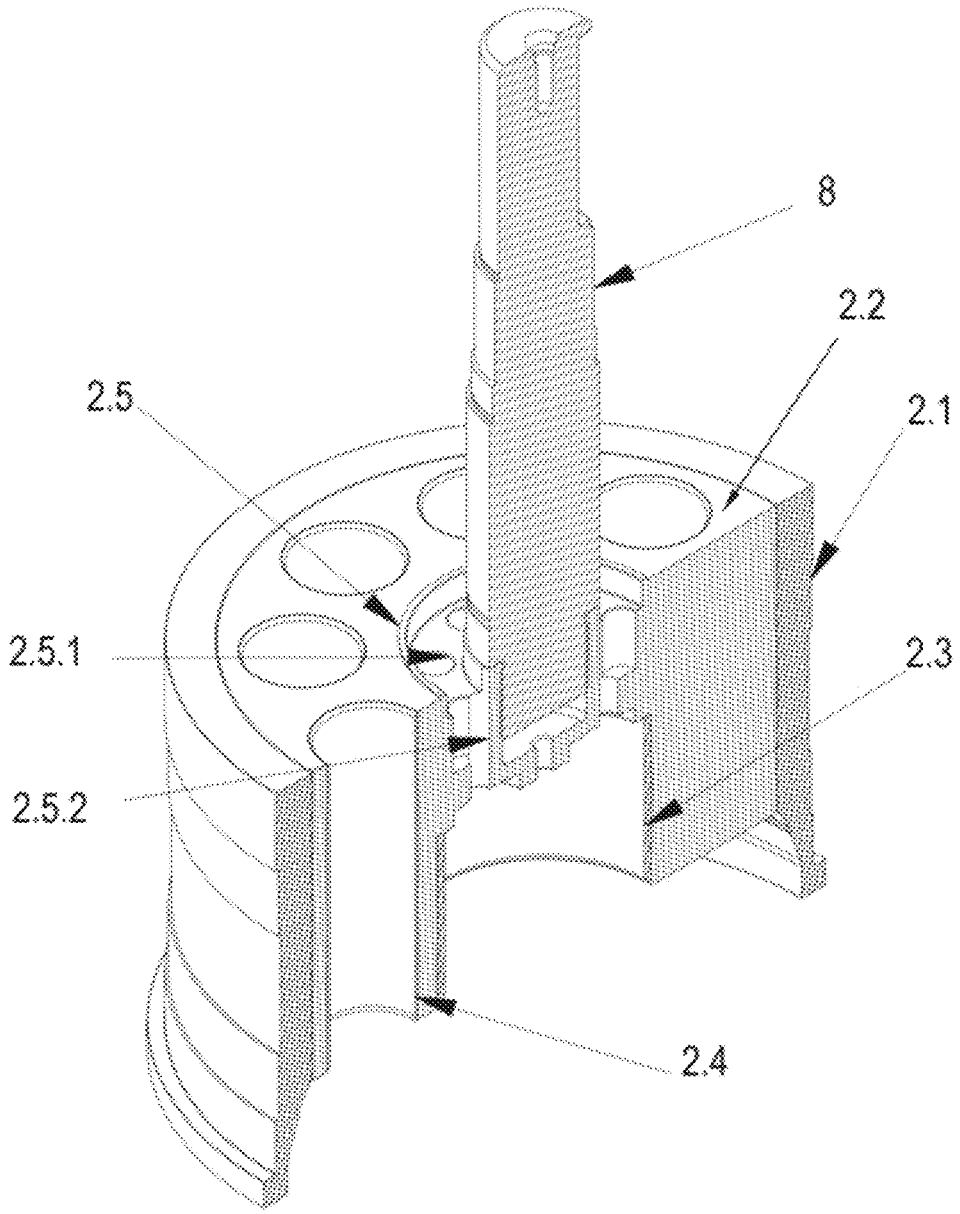
FIG. 12 is a schematic diagram illustrating a structure of a transmission shaft and a piston cylinder in an axial piston pump according to some embodiments of the present disclosure.

As shown in FIG. 4, the thrust plate guiding assembly 1.1 includes an annular plate. A plurality of through holes penetrating both upper and lower surfaces are arranged at intervals along the circumferential direction of the annular plate. Guide member 1.1.3 are installed at the through-holes on a lower surface of the plate. The guide member 1.1.3 is configured to hold a piston sleeve 2.4 that extends into the piston cylinder, as shown in FIG. 12. A guide seal member 1.1.4 is also mounted on the outer circumferential surface of the guide member 1.1.3 to achieve sealing between the guide member 1.1.3 and the piston sleeve 2.4. For example, the guide seal member 1.1.4 is a sealing ring. An upper surface of the annular plate is also provided with a through hole seal 1.1.2 surrounding the through hole. A plurality of bolts 1.1.1 are mounted on the annular plate to connect the thrust plate assembly 1.3 and the port plate assembly 1.4. The plurality of bolts 1.1.1 may be replaced by other fasteners.

Figure 5:
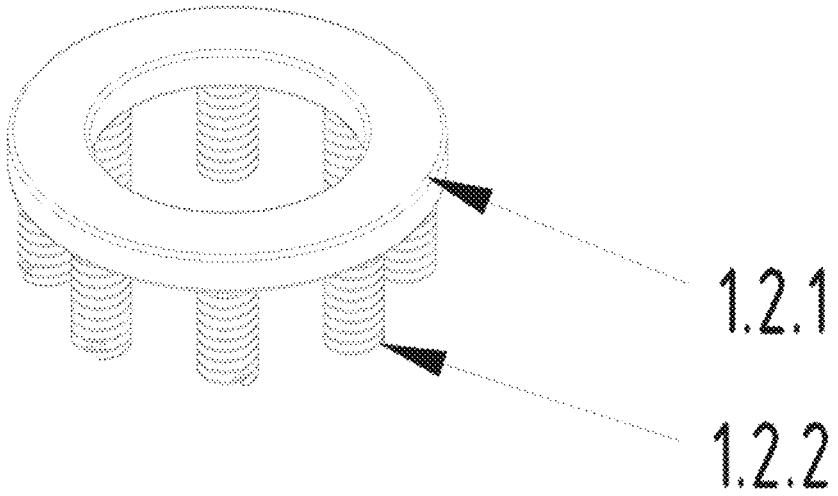
FIG. 5 is a schematic diagram illustrating a structure of a pre-sealing thrust mechanism shown in FIG. 3.

In some embodiments, as shown in FIG. 5, the pre-sealing thrust mechanism 1.2 includes a thrust retaining ring 1.2.1 and a plurality of thrust springs 1.2.2 mounted on the same side of the thrust retaining ring 1.2.1. The plurality of thrust springs 1.2.2 are arranged at intervals along the circumferential direction of the thrust retaining ring 1.2.1. The thrust retaining ring 1.2.1 is mounted in an annular groove on an end surface of the piston cylinder assembly 2. The annular groove is provided with thrust spring guide holes 2.5.1 for accommodating the thrust springs 1.2.2. As shown in FIG. 5, a plurality of thrust springs 1.2.2 are mounted on a lower surface of the thrust retaining ring 1.2.1 and are arranged at intervals along the circumferential direction of the thrust retaining ring 1.2.1. The annular groove is provided with a plurality of thrust spring guide holes 2.5.1 (as shown in FIG. 12), which are capable of accommodating the plurality of thrust springs 1.2.2 and providing guidance for the plurality of thrust springs 1.2.2.

Figure 6:
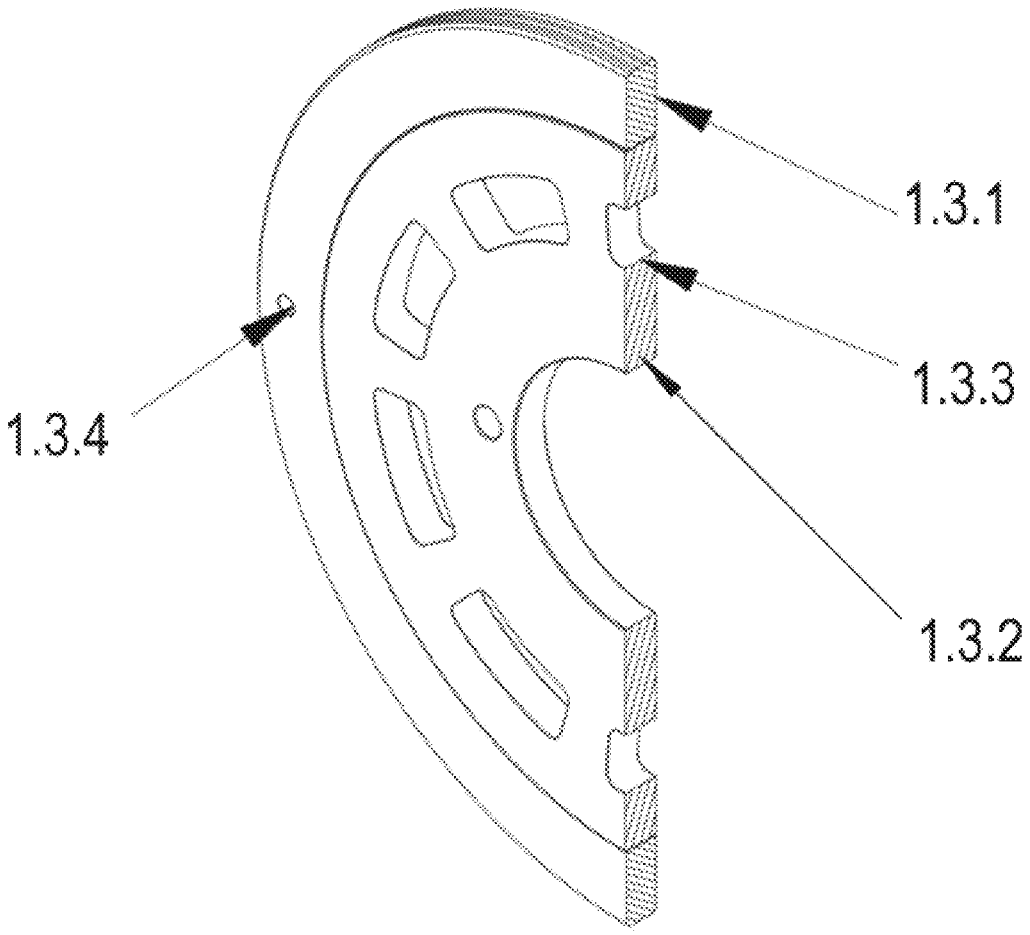
FIG. 6 is an axial sectional view illustrating a thrust plate assembly shown in FIG. 3.

In some embodiments, as shown in FIG. 6, the thrust plate assembly 1.3 includes a thrust plate support ring 1.3.1 and a thrust plate ceramic wear ring 1.3.2 connected coaxially. An outer cylindrical surface of the thrust plate ceramic wear ring 1.3.2 is assembled on an inner cylindrical surface of the thrust plate support ring 1.3.1, and the thrust plate support ring 1.3.1 is a metal ring. A plurality of valve holes 1.3.3 are arranged at intervals along the circumferential direction of the thrust plate ceramic wear ring 1.3.2.

As shown in FIG. 6, the thrust plate assembly 1.3 includes an inner ring and an outer ring connected coaxially, and the outer ring is the thrust plate support ring 1.3.1. The thrust plate support ring 1.3.1 may be made of stainless steel or other metallic materials. A plurality of threaded holes 1.3.4 are provided on thrust plate support ring 1.3.1 for connection with the plurality of bolts 1.1.1. The inner ring is the thrust plate ceramic wear ring 1.3.2. A plurality of valve holes 1.3.3 may be waist-shaped holes. An outer cylindrical surface of the thrust plate ceramic wear ring 1.3.2 is in close contact with an inner cylindrical surface of the thrust plate support ring 1.3.1. The thrust plate support ring 1.3.1 provides support for thrust plate ceramic wear ring 1.3.2, ensuring overall strength of a thrust plate.

Figure 7:
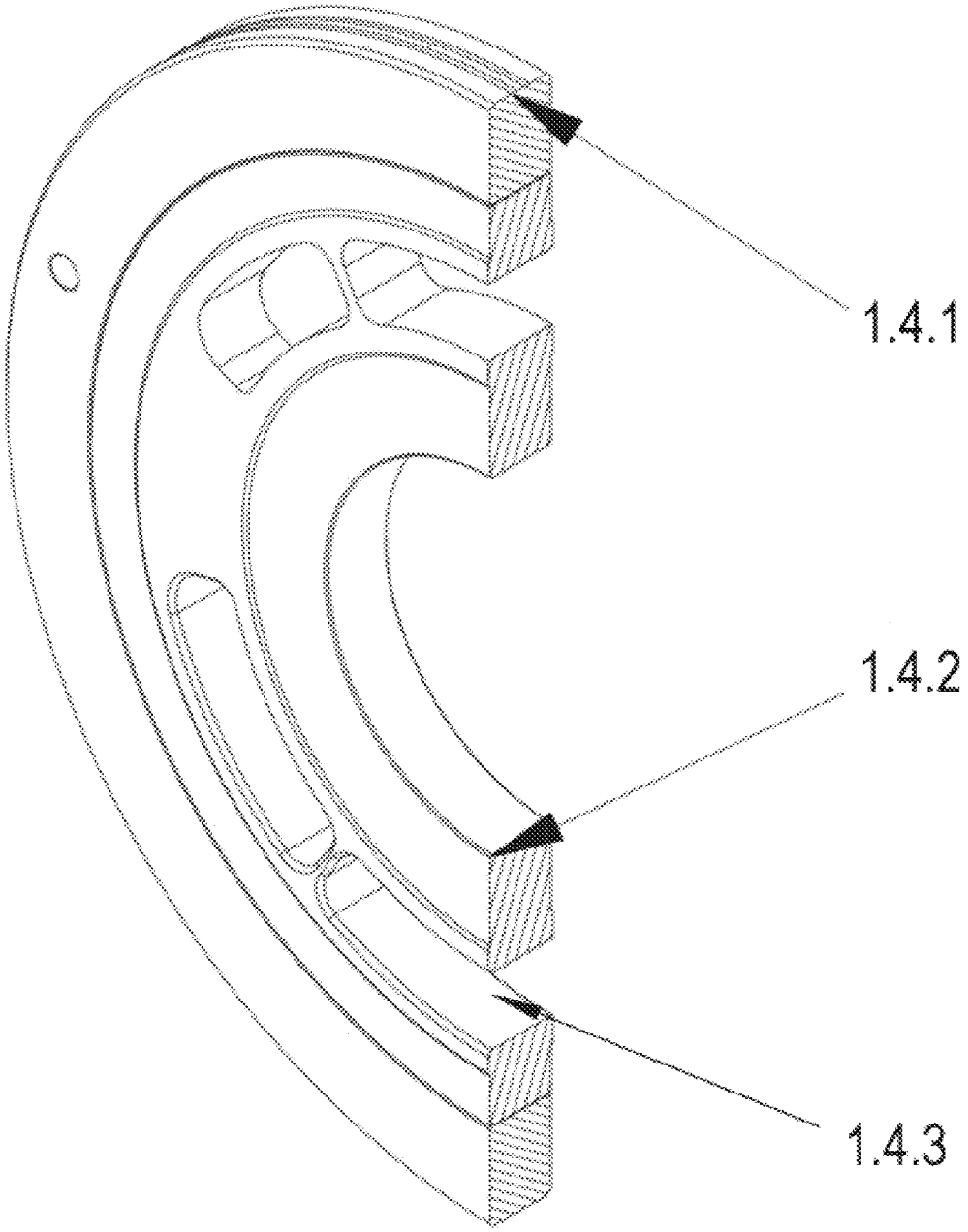
FIG. 7 is an axial sectional view illustrating a port plate shown in FIG. 3.

In some embodiments, as shown in FIG. 7, the port plate assembly 1.4 includes a port plate support ring 1.4.1 and a port plate ceramic wear ring 1.4.2 connected coaxially. The port plate support ring 1.4.1 is a metal ring. An outer cylindrical surface of the port plate ceramic wear ring 1.4.2 is assembled on an inner cylindrical surface of the port plate support ring 1.4.1. A plurality of port plate orifices 1.4.3 are arranged at intervals along the circumferential direction of the port plate ceramic wear ring 1.4.2.

As shown in FIG. 7, the port plate assembly 1.4 includes an inner ring and an outer ring connected coaxially. The outer ring is the port plate support ring 1.4.1, which is made of stainless steel or other metallic materials. The port plate support ring 1.4.1 is provided with holes for the plurality of bolts 1.1.1 to pass through. The inner ring is the port plate ceramic wear ring 1.4.2. The port plate orifice 1.4.3 is a waist-shaped hole. The outer cylindrical surface of the port plate ceramic wear ring 1.4.2 is in close contact with the inner cylindrical surface of the port plate support ring 1.4.1. The port plate support ring 1.4.1 provides support for the port plate ceramic wear ring 1.4.2, ensuring overall distributor strength of the port plate.

The through holes on thrust plate guiding assembly 1.1, the port plate orifices 1.4.3 on the port plate assembly 1.4, and the valve holes 1.3.3 on the thrust plate assembly 1.3 communicate to form a medium channel. As shown in FIG. 3, after connecting the thrust plate guiding assembly 1.1, the thrust plate assembly 1.3, and the port plate assembly 1.4, the through holes on the thrust plate guiding assembly 1.1, the port plate orifices 1.4.3 on the port plate assembly 1.4, and the valve holes 1.3.3 on the thrust plate assembly 1.3 are interconnected.

In some embodiments, as shown in FIG. 12, the piston cylinder assembly 2 includes a piston cylinder 2.2 and a hydrostatic inner ring 2.1 disposed on an outer side of the piston cylinder 2.2. A ceramic piston 4.1 of the piston assembly is movably mounted within the piston sleeve of the piston cylinder 2.2. One end of the piston cylinder 2.2 is drivingly connected to a transmission shaft 8, and a center hole at another end of the piston cylinder 2.2 is provided with the return guide sleeve 2.3, and the return guide sleeve 2.3 cooperates with the return guide column 4.4 in the forced return mechanism to provide cooperative guiding.

Figure 2:
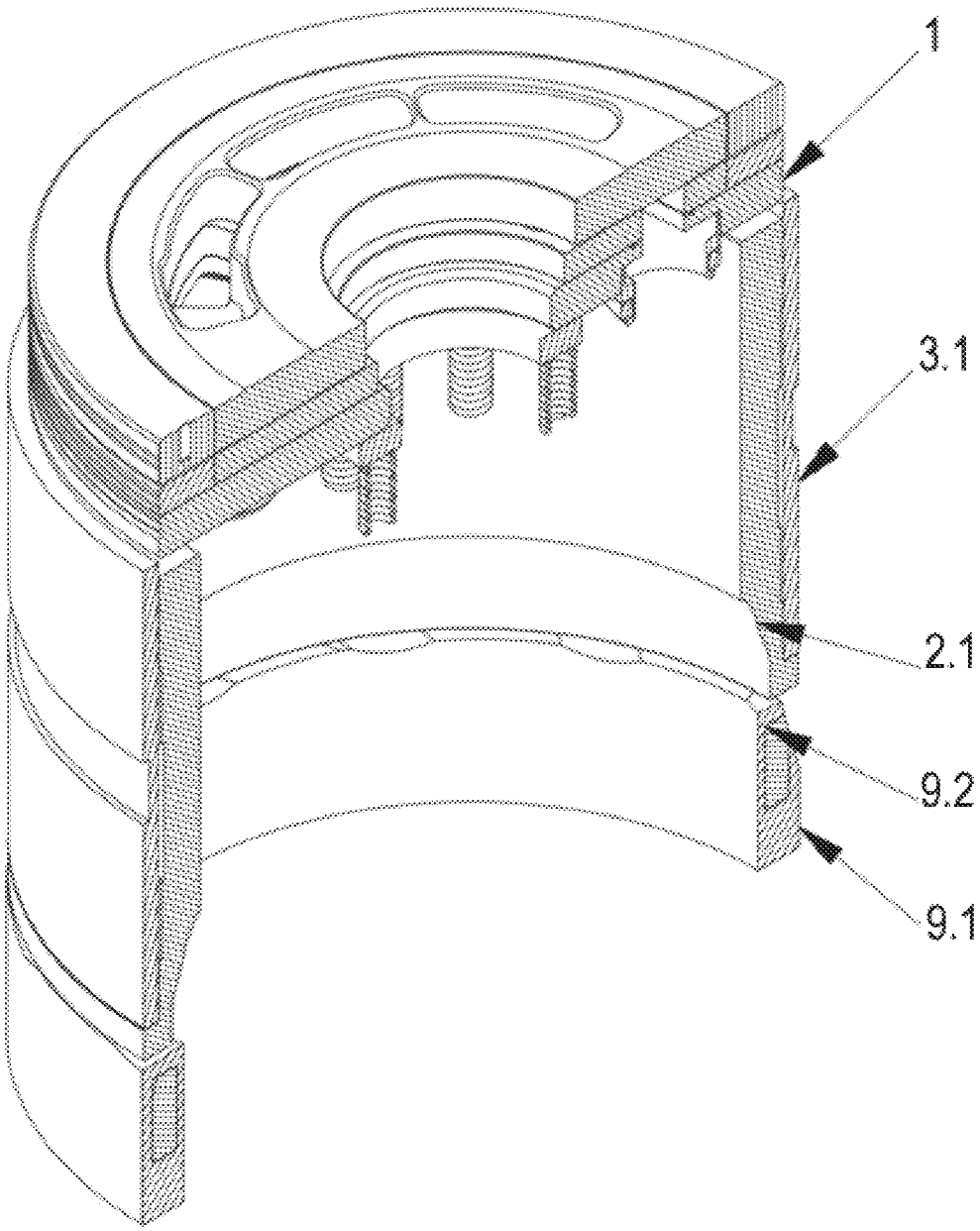
FIG. 2 is an axial sectional view illustrating a force-bearing assembly of an axial piston pump according to some embodiments of the present disclosure.
Figure 13:
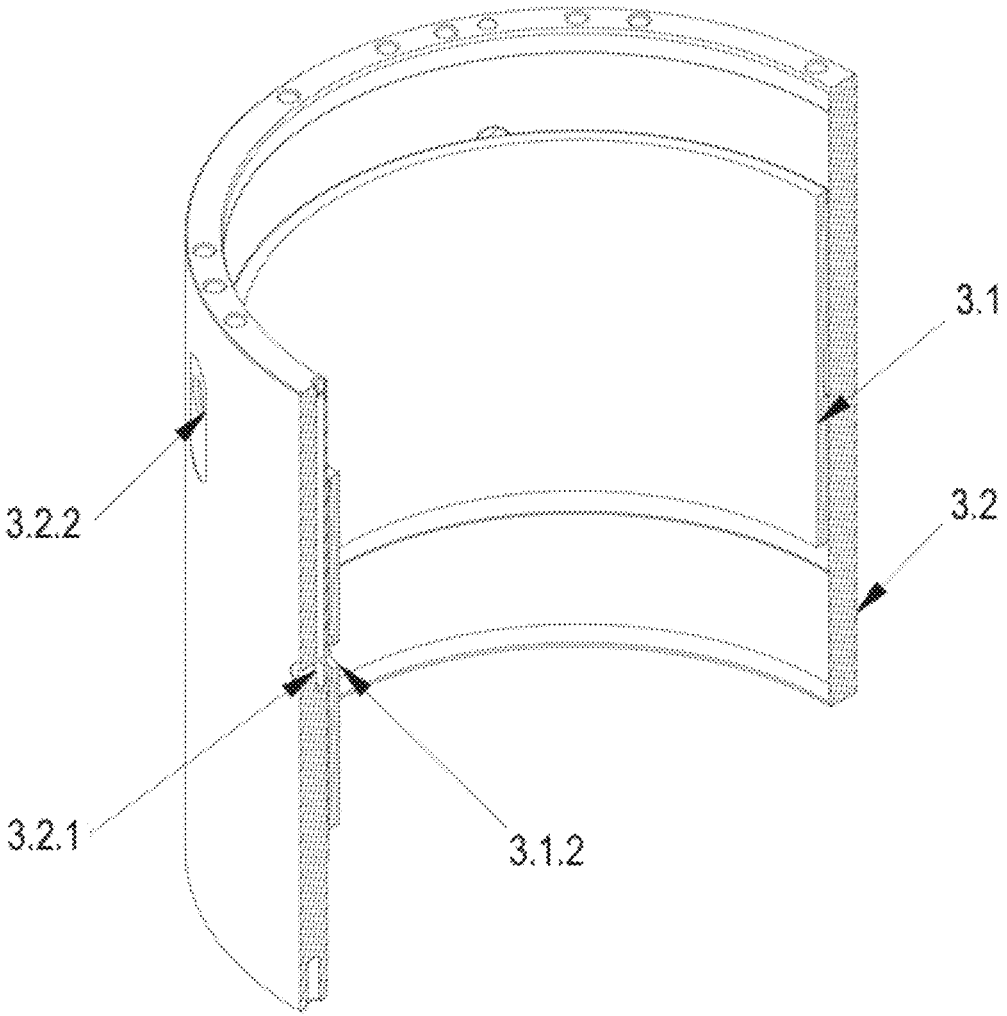
FIG. 13 is a schematic diagram illustrating a mating relationship between a pump housing and a hydrostatic outer ring in an axial piston pump according to some embodiments of the present disclosure.

As shown in FIG. 2 and FIG. 13, a hydrostatic inner ring 2.1 is mounted outside the piston cylinder 2.2 in the piston cylinder assembly 2. The pump housing assembly 3 includes a pump housing 3.2 and a hydrostatic outer ring 3.1 arranged on an inner side of the pump housing 3.2. The hydrostatic inner ring 2.1 and the hydrostatic outer ring 3.1 form the hydrostatic main bearing, which, together with the flow distribution and distribution sealing axial thrust bearing 1 and the end axial bearing 9, form the force-bearing assembly within the piston pump. As shown in FIG. 2, the flow distribution and distribution sealing axial thrust bearing 1 and the end axial bearing 9 are located at opposite ends of the hydrostatic main bearing respectively.

In some embodiments, both the hydrostatic outer ring 3.1 and the hydrostatic inner ring 2.1 are made of ceramic material and together form the hydrostatic main bearing. The hydrostatic outer ring 3.1 is supported on a support surface at an end of the hydrostatic inner ring 2.1. As shown in FIG. 2, a boss is provided on an outer side of the hydrostatic inner ring 2.1. An end face of the boss serves as the support surface for supporting the hydrostatic outer ring 3.1.

Figure 8:
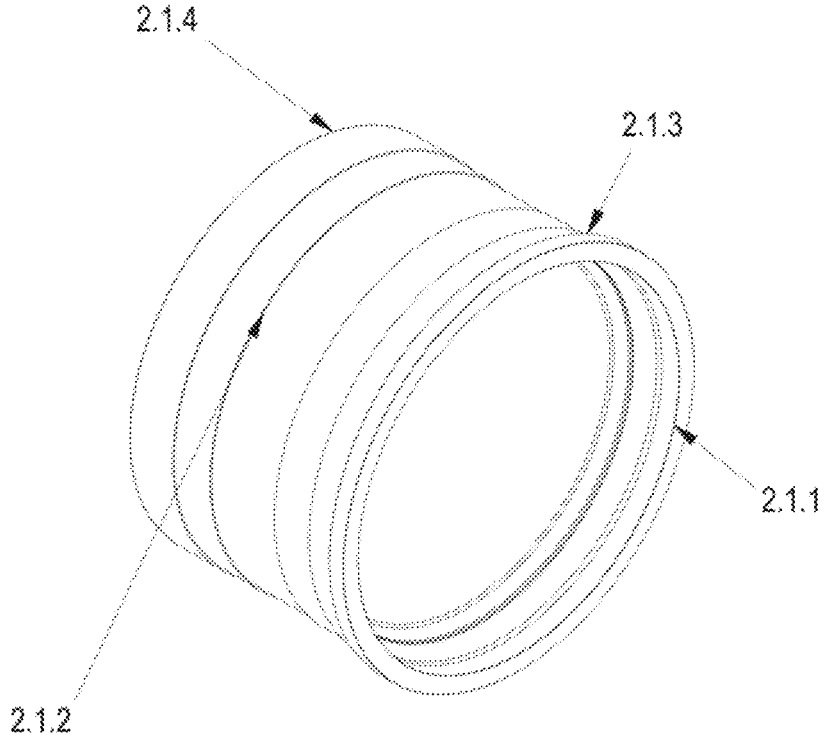
FIG. 8 is a schematic diagram illustrating a structure of a hydrostatic inner ring of a hydrostatic main bearing in the force-bearing assembly according to some embodiments of the present disclosure.
Figure 9:
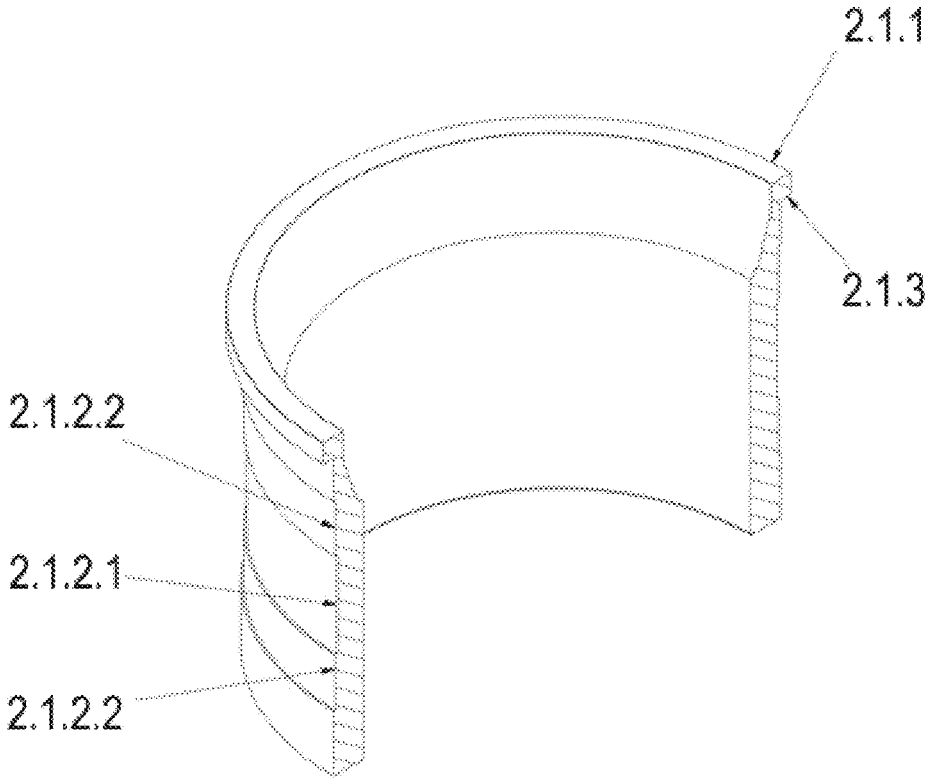
FIG. 9 is a sectional diagram illustrating a hydrostatic inner ring of a hydrostatic main bearing in the force-bearing assembly according to some embodiments of the present disclosure.

As shown in FIGS. 8 and 9, the hydrostatic inner ring 2.1 is a cylindrical ceramic structure, one end of which is provided with a radial flange. An end face of the radial flange is an inner ring friction surface 2.1.1, forming a friction pair with an end face of the end axial bearing 9. A surface on the radial flange opposite the inner ring friction surface 2.1.1 is a hydrostatic inner ring support surface 2.1.3, which provides friction contact with an end face of the hydrostatic outer ring 3.1. A damping ring band 2.1.4 is provided on the other end of the hydrostatic inner ring 2.1 relative to the radial flange, so as to facilitate formation of the damping required for hydrostatic support. A hydrostatic pad 2.1.2 is provided on an outer cylindrical surface of the hydrostatic inner ring 2.1.

In some embodiments, as shown in FIG. 9, the hydrostatic pad 2.1.2 of the hydrostatic inner ring 2.1 has a wedge-shaped stepped structure, and the hydrostatic pad 2.1.2 includes a first hydrostatic water pad 2.1.2.1 and two second hydrostatic water pads 2.1.2.2. A second hydrostatic water pad 2.1.2.2 is provided at each axial end of the first hydrostatic water pad 2.1.2.1. In order to avoid wear of the hydrostatic main bearing when no hydrostatic pressure is built up, the first hydrostatic water pad 2.1.2.1 and the second hydrostatic water pads 2.1.2.2, which have a wedge-shaped stepped structure, are capable of obtaining good hydrodynamic characteristics. As shown in FIG. 9, the first hydrostatic water pad 2.1.2.1 is lower than the two second hydrostatic water pads 2.1.2.2, forming a stepped structure. Both second hydrostatic water pads 2.1.2.2 are a wedge-shaped structure, and a small diameter end of each of the two second hydrostatic water pads is connected to the first hydrostatic water pad 2.1.2.1, thereby forming a wedge-shaped stepped structure.

According to some embodiments of the present disclosure, an outer cylindrical surface of the hydrostatic outer ring 3.1 is provided with a high-pressure water annular groove 3.1.1. The high-pressure water annular groove 3.1.1 communicates with the hydrostatic pad 2.1.2 through the hydrostatic main bearing pressure supply hole 3.1.2 provided in the high-pressure water annular groove 3.1.1. One end of the hydrostatic outer ring 3.1 is provided with a hydrodynamic support friction surface that frictionally contacts the support surface. The hydrodynamic support friction surface is provided with a plurality of first Archimedean spiral convection grooves 3.1.3 along its circumferential direction. An Archimedean spiral convection groove refers to a groove where a groove depth and/or a groove width follows or approximates the distribution of an Archimedes spiral.

Figure 10:
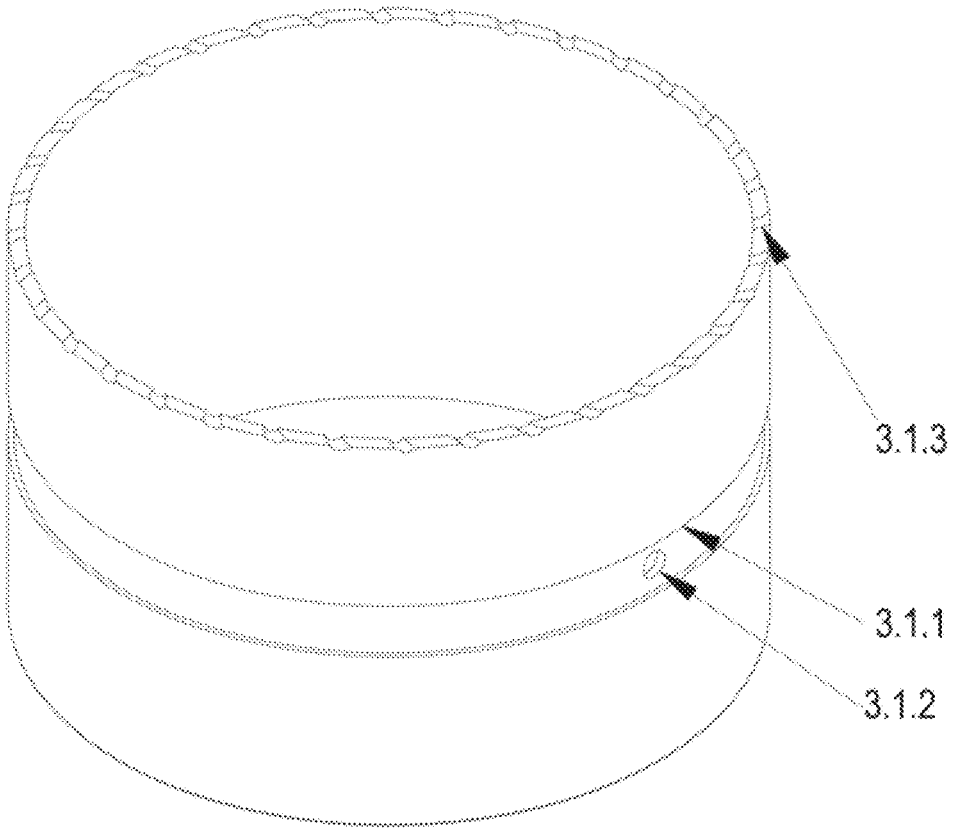
FIG. 10 is a schematic diagram illustrating a structure of a hydrostatic outer ring of a hydrostatic main bearing in the force-bearing assembly according to some embodiments of the present disclosure.

The hydrostatic outer ring 3.1 is a cylindrical ceramic structure sleeved on the outer cylindrical surface of the hydrostatic inner ring 2.1. As shown in FIG. 10, a hydrodynamic support friction surface 3.1.3 is provided at one end of the hydrostatic outer ring 3.1 for frictional contact with the hydrostatic inner ring support surface 2.1.3. First Archimedean spiral convection grooves are circumferentially arranged on the hydrodynamic support friction surface 3.1.3, so as to enhance convection, improve heat dissipation, strengthen hydrodynamic support, reduce friction and wear, and extend product lifespans. The high-pressure water annular groove 3.1.1 provides superior support for the ceramic hydrostatic main bearing, minimizing ceramic damage under cyclic loading. The high-pressure water annular groove 3.1.1 is located at a position where the bearing is subjected to the maximum shear stress. The high-pressure water annular groove 3.1.1 is provided with a hydrostatic main bearing pressure supply hole 3.1.2. After the hydrostatic outer ring 3.1 is assembled on the hydrostatic inner ring 2.1, the high-pressure water annular groove 3.1.1 corresponds to the first hydrostatic water pad 2.1.2.1 in the hydrostatic pad 2.1.2.

Figure 11:
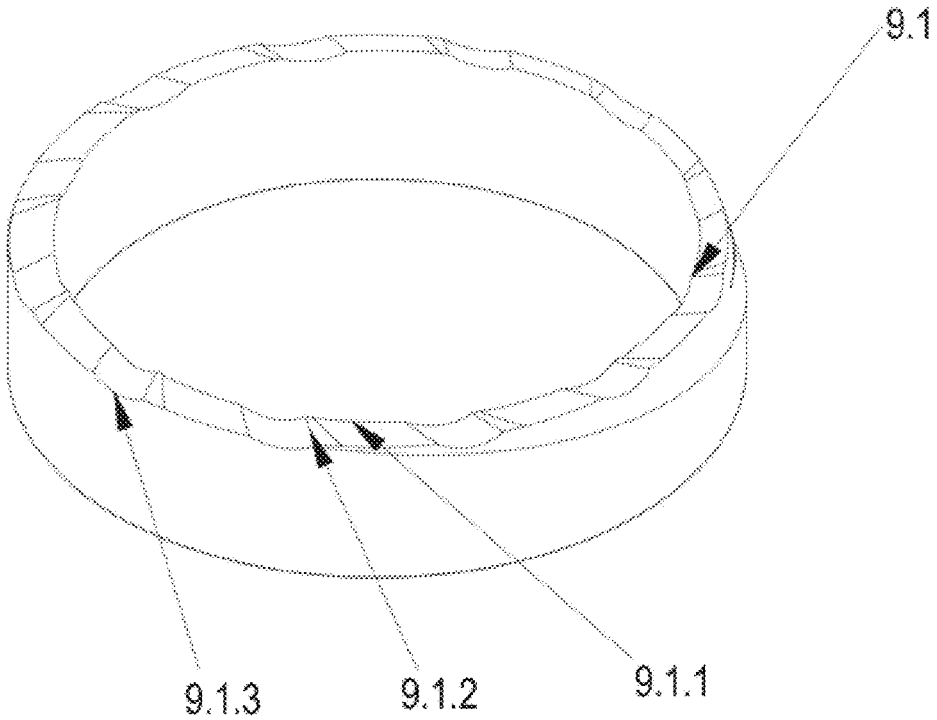
FIG. 11 is a schematic diagram illustrating a structure of an end axial bearing in the force-bearing assembly according to some embodiments of the present disclosure.

As shown in FIG. 11, the end axial bearing 9 is cylindrical in shape, for example, the end axial bearing 9 is a small-height cylindrical structure, the end axial bearing 9 is arranged around the swash plate assembly in the piston pump. The end axial bearing 9 includes a polyether ether ketone (PEEK) collar 9.1 and an alloy core 9.2 embedded in the PEEK collar 9.1 as shown in FIG. 2. Since the axial piston pump needs to withstand significant axial impacts, PEEK material with excellent toughness and wear resistance is selected for an outer collar structure, and the alloy core 9.2 made of metal material is embedded in the outer collar structure, which can enhance shear resistance of the PEEK collar.

An end face of the end axial bearing 9 facing the hydrostatic main bearing is provided with a composite surface. The composite surface contacts the inner ring friction surface 2.1.1 of the hydrostatic inner ring 2.1. The composite surface includes a wedge-shaped surface 9.1.1, a bearing support surface 9.1.2, and a second Archimedean spiral convection groove 9.1.3, which are connected sequentially. The wedge-shaped surface 9.1.1 has an angle of 1°-2°. In some embodiments, a plurality of composite surfaces are sequentially arranged circumferentially on the end face of the end axial bearing 9. The plurality of composite surfaces are configured to induce formation of hydrodynamic support, enhance hydrodynamic support, reduce friction and wear with the hydrostatic inner ring 2.1, and extend product lifespans. For example, each composite surface includes a wedge-shaped surface 9.1.1, a bearing support surface 9.1.2, and a second Archimedean spiral convection groove 9.1.3 connected sequentially. The bearing support surface 9.1.2 is planar and primarily serves as an auxiliary support. The second Archimedean spiral convection groove 9.1.3 can enhance convection, improve heat dissipation, increase hydrodynamic support, reduce friction and wear, and extend product lifespans.

The piston cylinder assembly 2, as shown in FIG. 12, includes the hydrostatic inner ring 2.1 and the piston cylinder 2.2. The piston cylinder 2.2 is sleeved on an inner cylindrical surface of the hydrostatic inner ring 2.1. A center of the piston cylinder 2.2 is drivingly connected to the transmission shaft 8, which drives the piston cylinder 2.2 to rotate. A plurality of piston holes, each housing an embedded piston sleeve 2.4, are uniformly distributed around the transmission shaft 8 on the piston cylinder 2.2. The piston sleeve 2.4 is made of ceramic, and the arrangement of the piston sleeve 2.4 can avoid wear of the piston holes by the piston. After the wear of the plunger sleeve 2.4 occurs in a period of time of use, it is only necessary to replace the piston sleeve 2.4 to avoid overall replacement of the piston cylinder 2.2. A return guide sleeve 2.3 is also embedded at a center of the piston cylinder 2.2 and is used to cooperate with the forced return mechanism to guide forced return of the piston. An alloy insert sleeve 2.5 is also embedded around the transmission shaft 8 on the piston cylinder 2.2. An end face of the alloy insert sleeve 2.5 is provided with a countersunk groove for installing thrust retaining ring 1.2.1. A bottom of the countersunk groove is provided with a plurality of circumferentially distributed thrust spring guide holes 2.5.1 to accommodate the thrust spring 1.2.2 and guide compression of the thrust spring 1.2.2. The alloy insert sleeve 2.5 is also provided with convection holes 2.5.2 for heat dissipation of the transmission shaft.

In some embodiments of the present disclosure, the friction pair is the ceramic friction pair and ceramic structural parts are reinforced by using alloy, which optimizes lubrication design of the friction pair. More hydrostatic support lubrication improves tolerance to media particles, therefore media feed water does not require treatment with a filter of 5 μm, but rather a conventional filter of 20 μm, thus extending a application range of the axial piston pump.

The pump housing assembly 3, as shown in FIG. 13, includes a pump housing 3.2 on an outer side and a hydrostatic outer ring 3.1 on an inner side. The pump housing 3.2 is made of corrosion-resistant metal material and is provided with a hydrostatic support high-pressure water plug hole 3.2.1 and a pump housing convection pipe interface 3.2.2. The hydrostatic support high-pressure water plug hole 3.2.1 is aligned with and communicates with the hydrostatic main bearing pressure supply hole 3.1.2. The pump housing convection pipe interface 3.2.2 is a threaded interface, which is used to connect with external convection pipes for venting, emptying, or blowdown of the piston pump.

Figure 14:
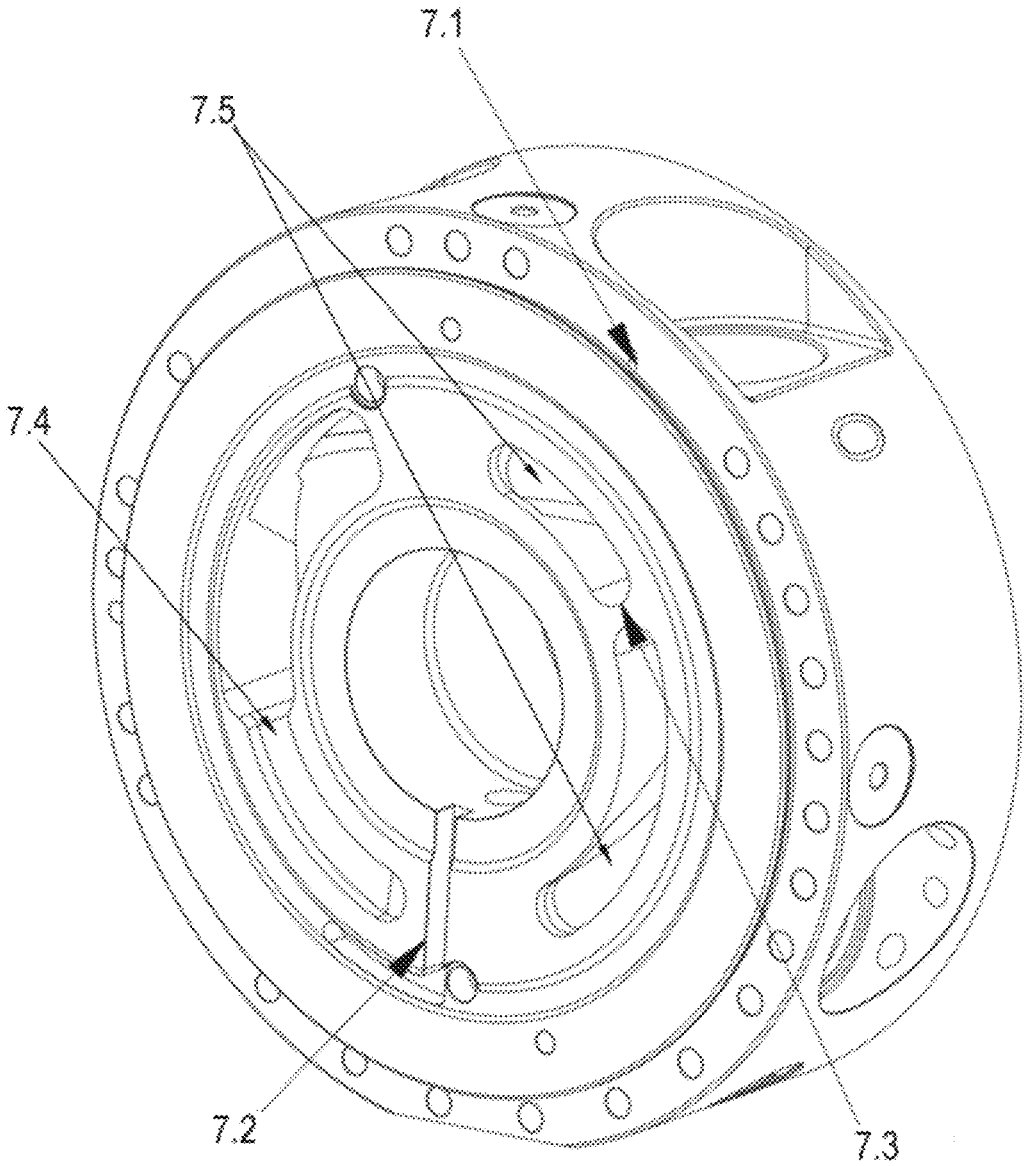
FIG. 14 is a schematic diagram illustrating a structure of an inlet and outlet flange in an axial piston pump according to some embodiments of the present disclosure.

A structure of inlet and outlet flange 7 is shown in FIG. 14. The inlet and outlet flange 7 is made entirely of ceramic material, which is provided with a hydrostatic bearing high-pressure water supply port 7.1, a convection groove 7.2, a water inlet 7.4, and a water outlet 7.5. The hydrostatic bearing high-pressure water supply port 7.1 supplies high-pressure water for hydrostatic support of the hydrostatic main bearing composed of the hydrostatic inner ring 2.1 and the hydrostatic outer ring 3.1 through a gap between the flow distribution and distribution sealing axial thrust bearing 1 and the pump housing. The convection channel 7.2 is used for heat dissipation and cooling. The water inlet 7.4 and the water outlet 7.5 are both arranged around the flange hole at the center of the inlet and outlet flange 7, serving for water inflow or outflow of the piston pump. Both the water inlet 7.4 and the water outlet 7.5 are arranged on a side of inlet and outlet flange 7, while a portion of high-pressure water discharged from the water outlet 7.5 may re-enter hydrostatic bearing high-pressure water supply port 7.1. Flange holes are configured to allow the transmission shaft 8 to pass through. An edge of the water outlet 7.5 is provided with a reinforcing rib 7.3. Since the water outlet 7.5 needs to discharge high-pressure water, the reinforcing rib 7.3 can compensate for brittleness of ceramic materials.

Figure 15:
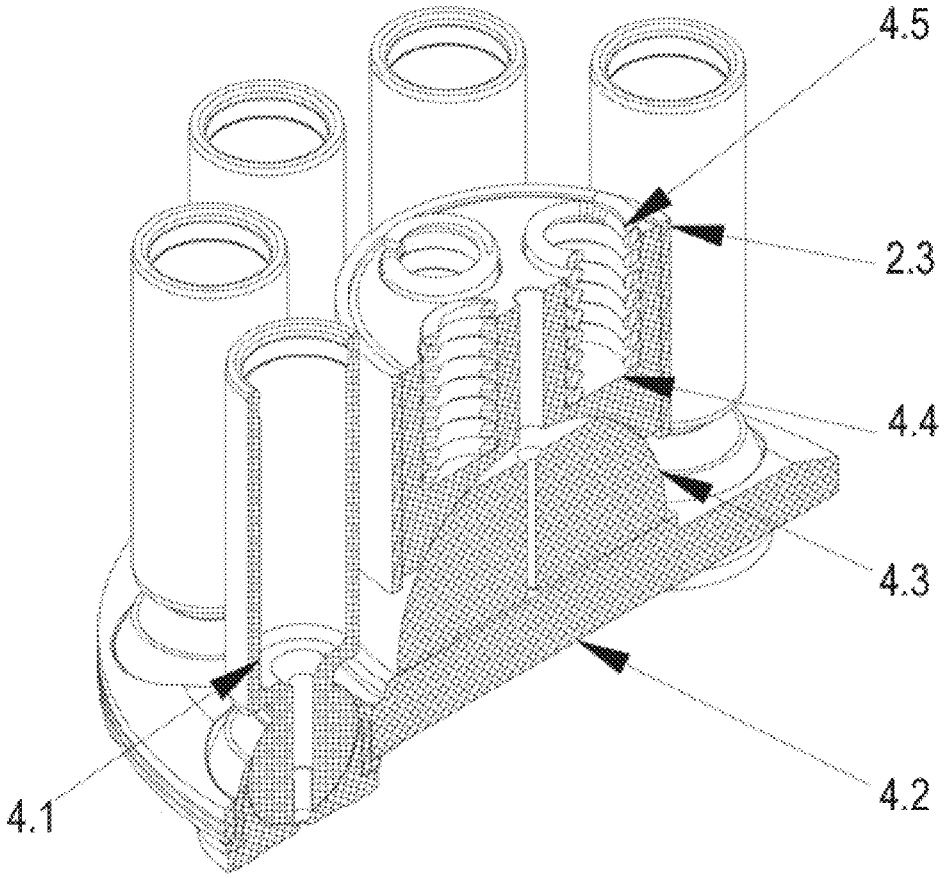
FIG. 15 is a schematic diagram illustrating a structure of a piston and piston forced return assembly in an axial piston pump according to some embodiments of the present disclosure.
Figure 19:
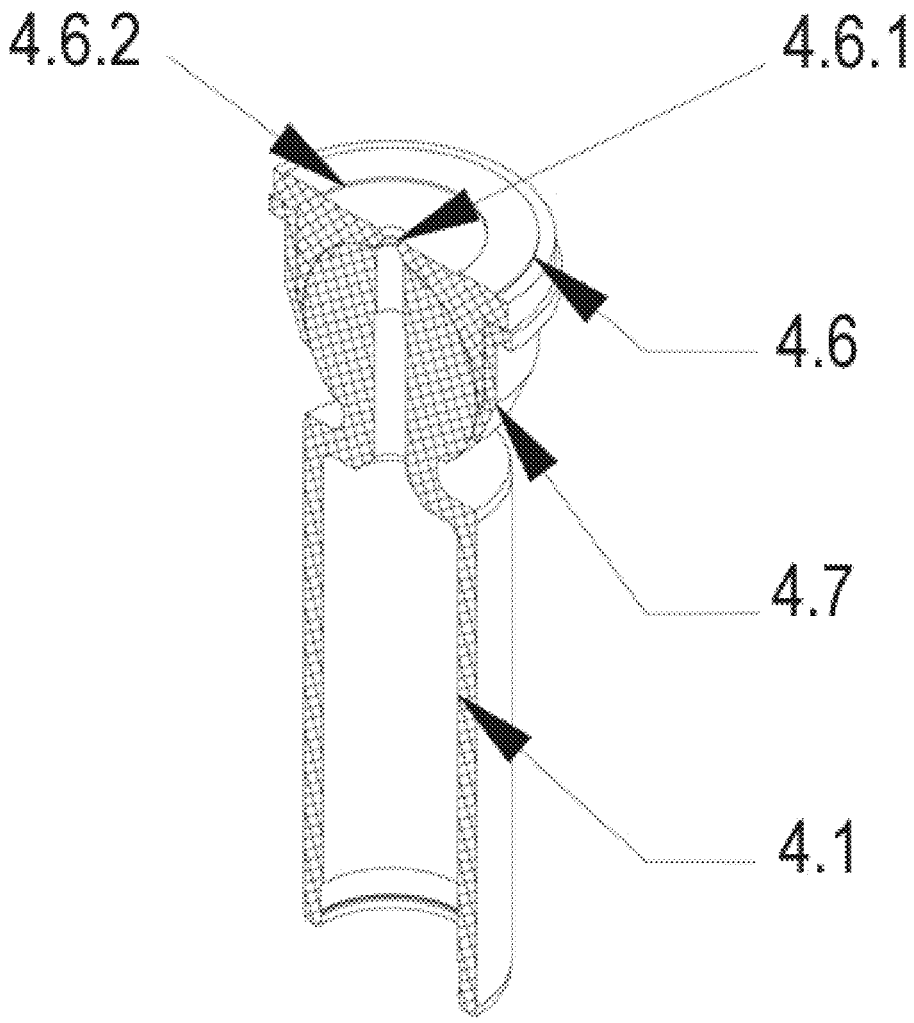
FIG. 19 is a schematic diagram illustrating a structure of a piston and a combined slipper in an axial piston pump according to some embodiments of the present disclosure.
Figure 20:
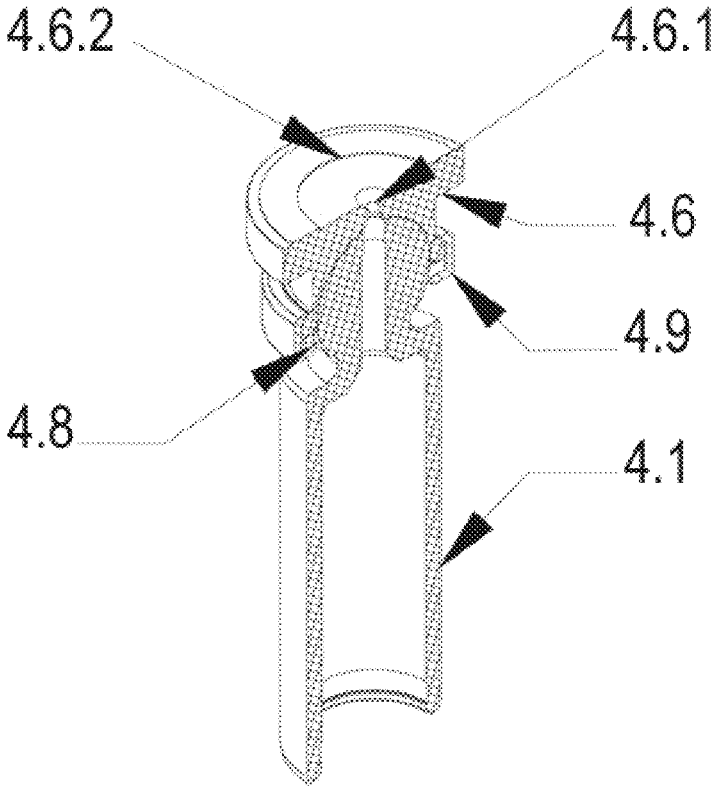
FIG. 20 is a schematic diagram illustrating a structure of a piston and a press-type slipper in an axial piston pump according to some embodiments of the present disclosure.

In some embodiments, as shown in FIG. 15, the piston and piston forced return assembly 4 includes a piston assembly and a forced return mechanism. The piston assembly includes combined the ceramic piston 4.1 and a ceramic slipper 4.6, as shown in FIGS. 19 and 20. The forced return mechanism includes a return plate 4.2, a spherical hinge 4.3, a return guide column 4.4, and a plurality of preload springs 4.5. The ceramic slipper 4.6 is connected to the return plate 4.2 and supported on a swash surface of the swash plate assembly 5. A plane of the spherical hinge 4.3 and the return plate 4.2 form a plane friction pair, and a spherical surface of the spherical hinge 4.3 is hinged to a spherical socket 4.4.1 of return guide column 4.4. The return guide column 4.4 is mounted within the return guide sleeve 2.3 of the piston cylinder assembly 2. A plurality of spring holes for installing the plurality of preload springs 4.5 are provided on a surface of the return guide column 4.4 opposite to the spherical socket 4.4.1. Ends of the plurality of preload springs 4.5 protrude from the plurality of spring holes and abut against the piston cylinder assembly 2.

The ceramic piston 4.1 is connected to the return plate 4.2 via the ceramic slipper 4.6. A surface of the spherical hinge 4.3 is a plane and the other surface of the spherical hinge 4.3 is a spherical surface. The spherical hinge 4.3 is arranged at the center of the return plate 4.2. The plane of the spherical hinge 4.3 and the return plate 4.2 form an elliptical plane friction pair. The return guide column 4.4 is made of ceramic materials. The return guide column 4.4 is mounted within the return guide sleeve 2.3, and the return guide sleeve 2.3 is embedded in the piston cylinder 2.2. One end of the return guide column 4.4 forms a spherical joint with the spherical surface of the spherical hinge 4.3, while the other end of the spherical hinge 4.3 is provided with spring holes for installing preload springs 4.5. The preload spring 4.5 is a spring with a moderate preload, with 0.1-0.2 mm of free movement space to reliably support the safety forced return. Under normal operating conditions, the piston pump relies on the return plate 4.2, the spherical hinge 4.3, and the return guide column 4.4 to perform a return work of the piston assembly. The preload spring 4.5 serves only as auxiliary support and cushioning and does not actuate. In response to being subjected to significant external impact forces, rigid structures of the return plate 4.2, the spherical hinge 4.3, and the return guide column 4.4 may undergo slight displacement. At this point, a rebound force of the preload spring 4.5 provides support for unloading return stroke, preventing jamming and avoiding irreversible product damage caused by return failure.

Figure 16:
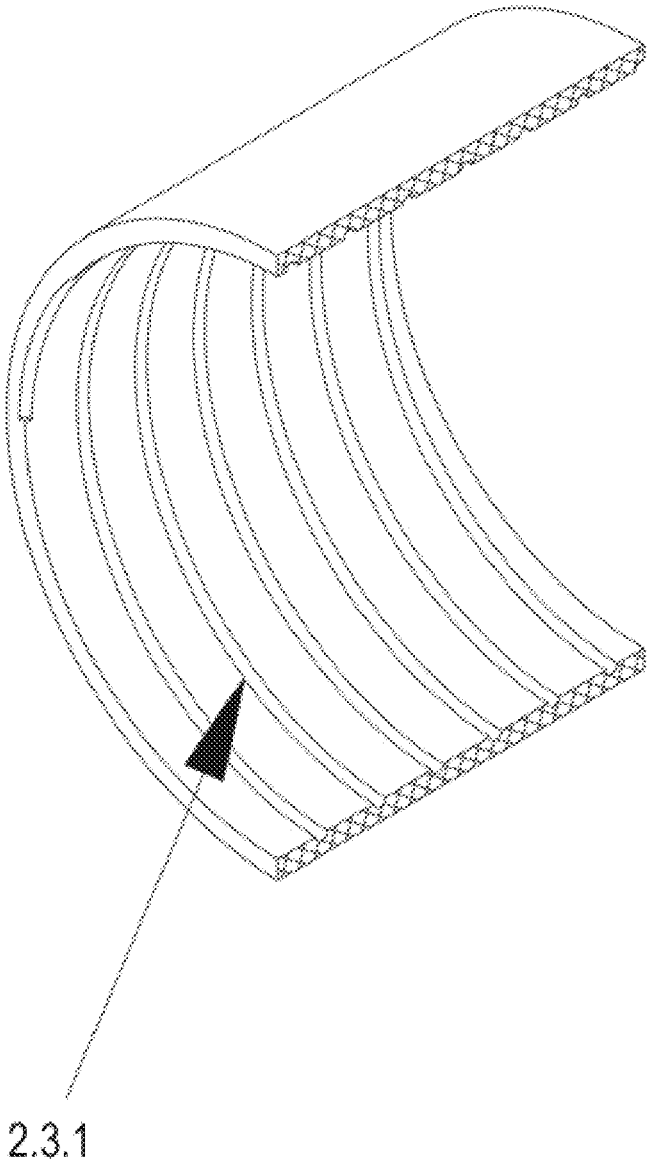
FIG. 16 is a schematic diagram illustrating a structure of a return guide sleeve shown in FIG. 15.

As shown in FIG. 16, the return guide sleeve 2.3 is made of ceramic materials. A helical lubrication channel 2.3.1 is provided on an inner cylindrical surface of the return guide sleeve 2.3. The helical lubrication channel 2.3.1 facilitates heat dissipation and lubrication under high-temperature and high-pressure conditions, so as to prevent thermal expansion jamming of materials while reducing a friction surface area between the materials and the return guide column 4.4 to minimize wear.

Figure 17:
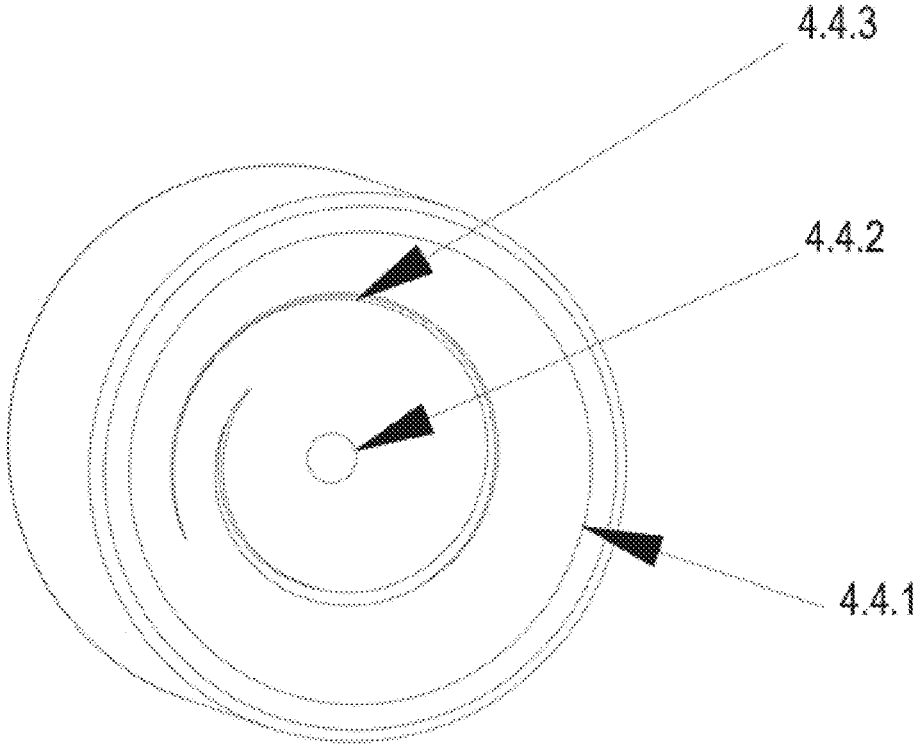
FIG. 17 is a schematic diagram illustrating a structure of a return guide column shown in FIG. 15.

As shown in FIG. 17, a surface of the return guide column 4.4 forming a spherical joint with the spherical hinge 4.3 is provided with the spherical socket 4.4.1. A central through hole 4.4.2 is provided at a center of the spherical socket 4.4.1 to facilitate heat dissipation and lubricate a spherical surface of the spherical hinge 4.3. An Archimedean spiral damping groove 4.4.3 is also provided around the central through hole 4.4.2 on the spherical socket 4.4.1. A grooving direction of the Archimedean spiral damping groove 4.4.3 aligns with a rotational direction, with a groove depth and a groove width gradually varying along rotation of a groove. Arrangement of the Archimedean spiral damping groove 4.4.3 can enhance support force, improve lubricity, reduce friction, minimize wear, and extend component lifespans.

Figure 18:
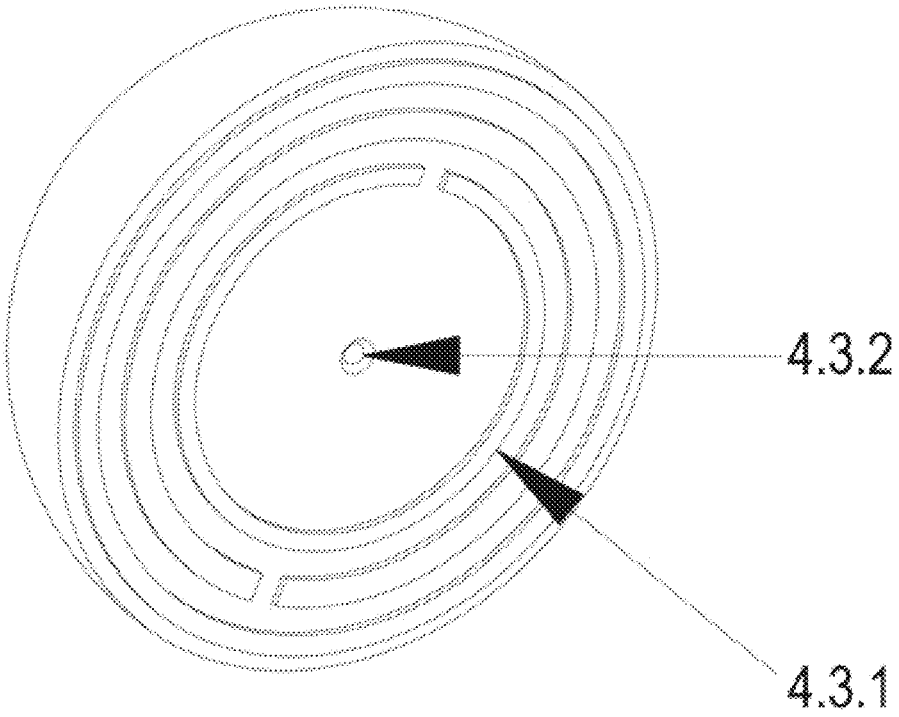
FIG. 18 is a schematic diagram illustrating a structure of a spherical hinge in FIG. 15.

As shown in FIG. 18, a bottom surface of the spherical hinge 4.3 is provided with convection damping holes 4.3.2 that penetrate the spherical surface. The convection damping holes 4.3.2 communicate with the central through hole 4.4.2 of the return guide column 4.4, thus facilitating water flow. A labyrinth hydrostatic support water pad 4.3.1 is arranged around the convection damping hole 4.3.2 on the spherical socket 4.4.1. The labyrinth hydrostatic support water pad 4.3.1 can enhance end-face support force of the spherical hinge at relatively low hydrostatic pad water supply pressure, improve lubrication of friction, reduce friction and wear, and extend component lifespans.

Figure 21:
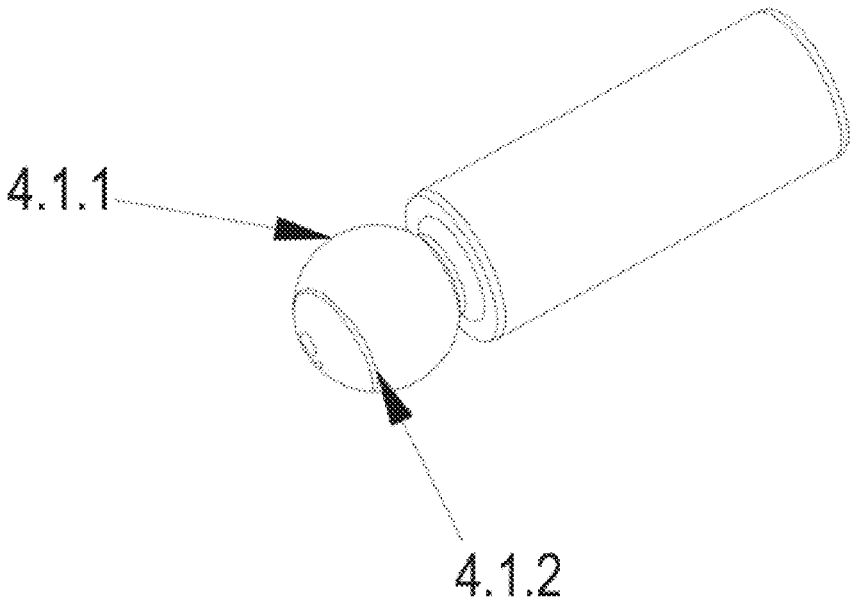
FIG. 21 is a schematic diagram illustrating a structure of the piston in an axial piston pump according to some embodiments of the present disclosure.

FIGS. 19-21 illustrate structures of the piston assembly, including various combinations of the ceramic piston 4.1 and the ceramic slipper 4.6.

In some embodiments, as shown in FIG. 19, in the structure of the ceramic piston 4.1 and the combined slipper, the combined slipper includes a ceramic slipper 4.6 and a ceramic pressure sleeve 4.7. The piston ball head 4.1.1 of the ceramic piston 4.1 mates with the spherical surface of the ceramic slipper 4.6, and the ceramic pressure sleeve 4.7 is installed outside the ceramic slipper 4.6 as the spherical necking of the ceramic slipper 4.6. The ceramic pressure sleeve 4.7 encases both the ceramic slipper 4.6 and the piston ball head 4.1.1, preventing the ceramic piston 4.1 from detaching from the ceramic slipper 4.6.

In some embodiments, as shown in FIG. 20, in the structure of the ceramic piston 4.1 and a press-type slipper, the press-type slipper includes the ceramic slipper 4.6, a ceramic ring 4.8, and a metal buckle ring 4.9. The piston ball head 4.1.1 of the ceramic piston 4.1 mates with the spherical surface of the ceramic slipper 4.6. A radial flange is provided along an edge of the spherical surface of the ceramic slipper 4.6. The ceramic ring 4.8 is sleeved on the piston ball head 4.1.1 and closely abuts against the radial flange. The metal buckle ring 4.9 is provided with a crimping groove on its inner cylindrical surface, and the radial flange and the ceramic ring 4.8 are buckled into the crimping groove by the metal buckle ring 4.9, which serves as a spherical necking of the ceramic slipper 4.6 and wraps around the ceramic slipper 4.6 and the piston ball head 4.1.1, to avoid the ceramic piston 4.1 from falling off the ceramic slipper 4.6.

Whether in the combined slipper or the press-type slipper, a thin-walled small-hole slipper damping hole 4.6.1 is provided at an end face center of the ceramic slipper 4.6, to enhance thermal tolerance. A hydrostatic water pad 4.6.2 with a sealing strip is arranged around the slipper damping hole 4.6.1.

In some embodiments, as shown in FIG. 21, a central hole is provided at a center of the piston ball head 4.1.1 of the ceramic piston 4.1. The central hole may communicate with the slipper damping hole 4.6.1 and the inner chamber of the ceramic piston 4.1. The spherical surface of the piston ball head 4.1.1 is also provided with a ball head damping groove 4.1.2, which is an Archimedean spiral groove, so as to enhance support force, improve lubrication, reduce friction and wear, extend lifespans of components.

Figure 22:
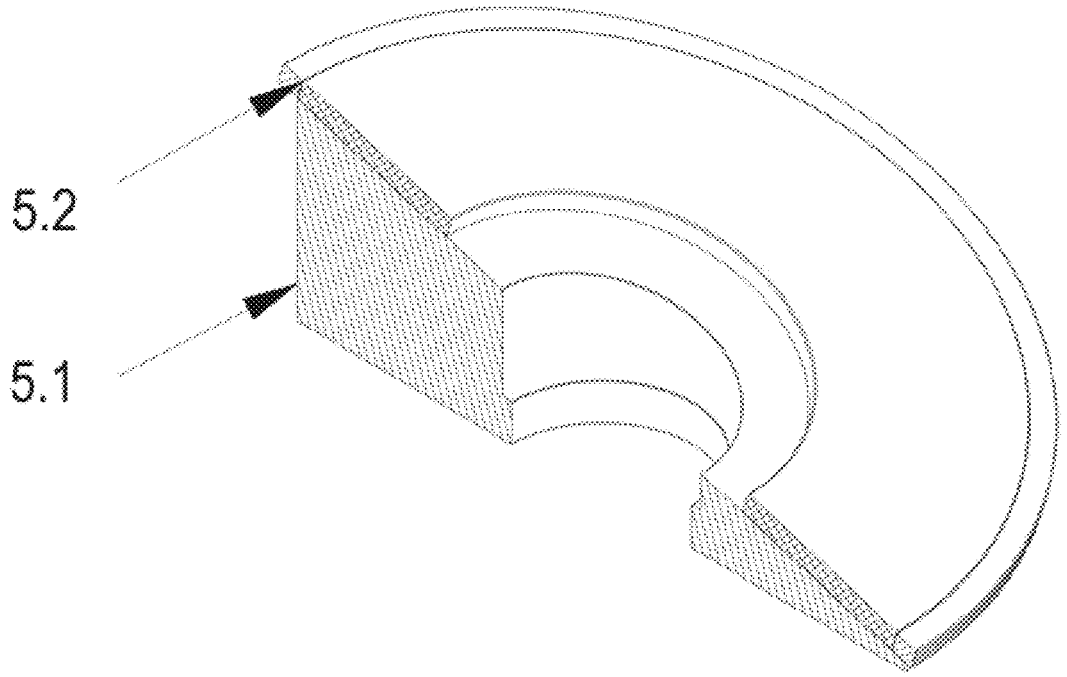
FIG. 22 is a schematic diagram illustrating a structure of a swash plate assembly in an axial piston pump according to some embodiments of the present disclosure.
Figure 23:
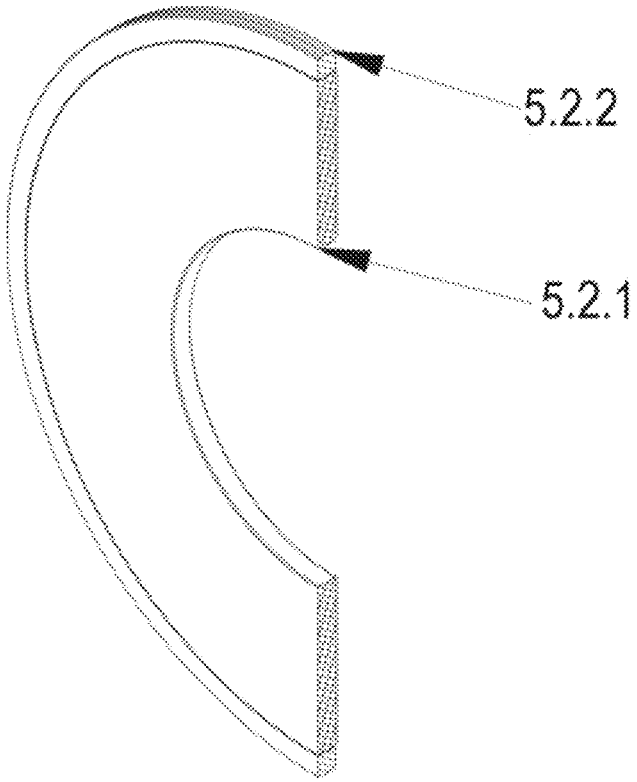
FIG. 23 is a schematic diagram illustrating a structure of a friction plate shown in FIG. 22.

A structure of the swash plate assembly 5 is shown in FIG. 22, including the swash plate 5.1 and a friction plate 5.2. The swash plate 5.1 is made of corrosion-resistant alloy materials to reduce ceramic usage and lower costs. The swash plate 5.1 includes an annular swash surface. The friction plate 5.2 is bonded to the swash surface of swash plate 5.1 using an adhesive. A structure of the friction plate 5.2, as shown in FIG. 23, includes a ceramic inner ring 5.2.1 and a metal outer ring 5.2.2. The ceramic inner ring 5.2.1 and the metal outer ring 5.2.2 are connected by interference fit, with the metal outer ring 5.2.2 compensating for brittleness of the ceramic inner ring 5.2.1.

Figure 24:
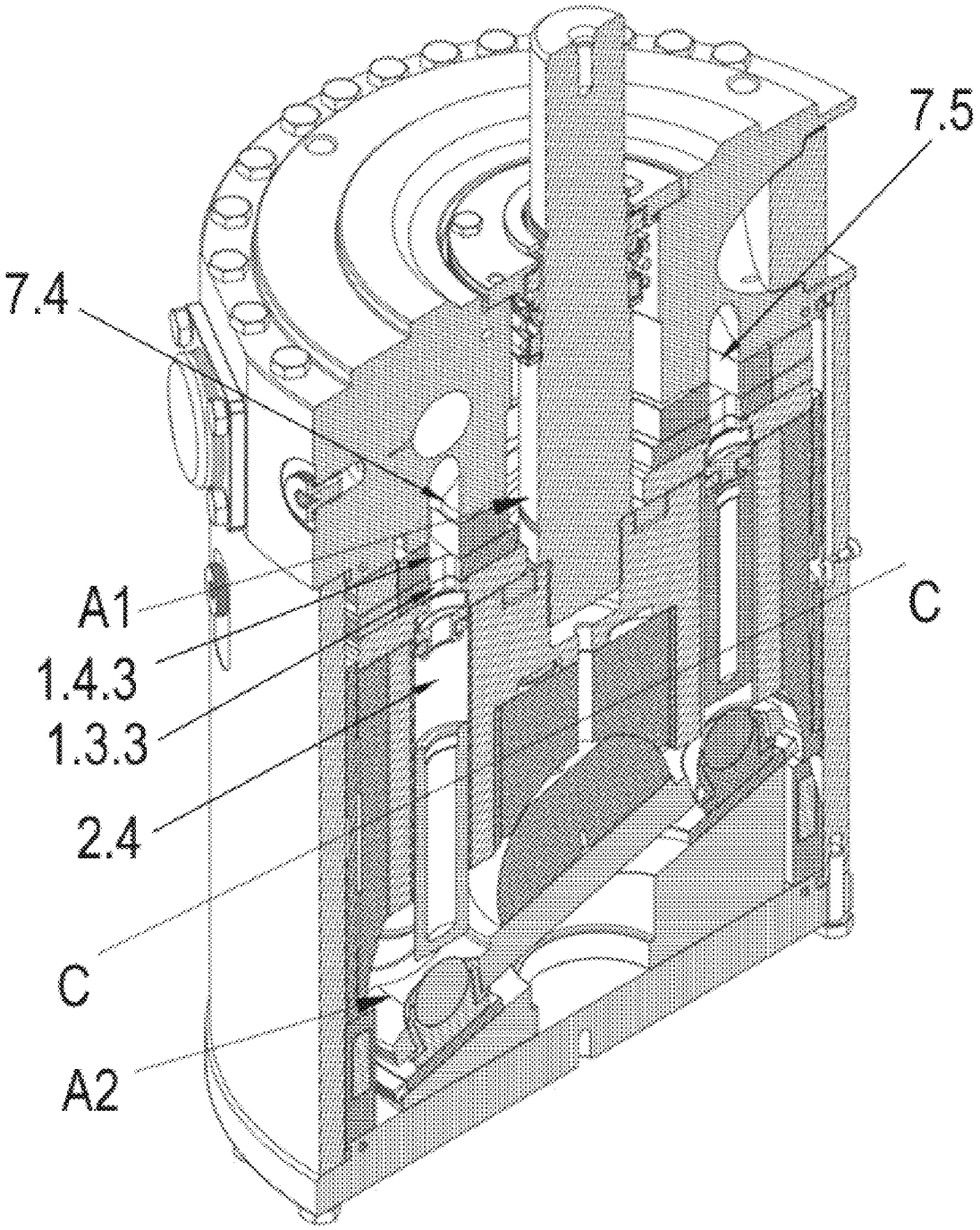
FIG. 24 is a schematic diagram illustrating a principle of convection through external pipelines required for an axial piston pump according to some embodiments of the present disclosure.
Figure 25:
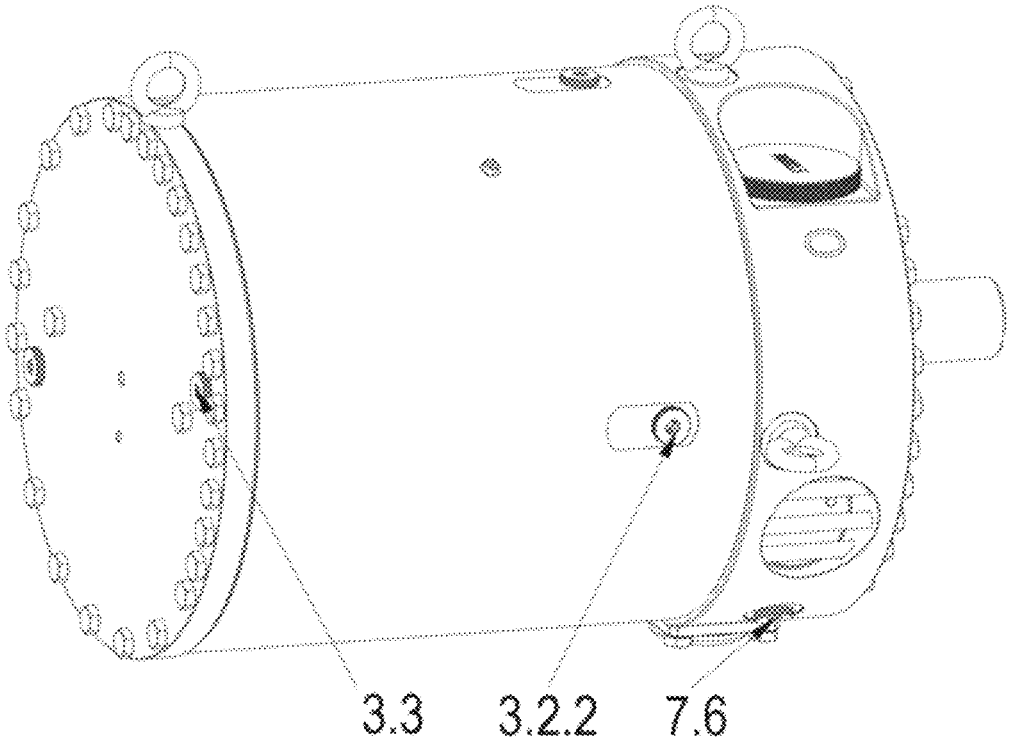
FIG. 25 is a schematic diagram illustrating arrangement of convection holes on an exterior of an axial piston pump according to some embodiments of the present disclosure.

As shown in FIG. 24, in the piston pump provided by some embodiments of the present disclosure, with the CC line passing through an active area of the piston as the boundary, due to setting of the hydrostatic main bearing and the forced return mechanism, the low-pressure chamber A1 located between the transmission shaft and the inlet and outlet flange on one side of the CC line, and the low-pressure chamber A2 located between the return plate and the piston cylinder assembly on the other side of the CC line do not have convection. Therefore, a convection interface needs to be provided on a side or a bottom surface of the pump to facilitate convection through external pipelines. The convection interface, as shown in FIG. 25, includes a pump housing convection pipe interface 3.2.2 provided on the pump housing, a pump base convection pipe interface 3.3 provided at the pump base, and a flange convection pipeline interface 7.6 provided on a side of the inlet and outlet flange 7. One end of the pump base convection pipe interface 3.3 may connect to the low-pressure chamber A2, while the other end connects to an external convection pipeline. One end of the flange convection pipeline interface 7.6 may connect to the low-pressure chamber A1, while the other end may connect to an external convection pipe. By the threaded connection between the provided convection interfaces and the external convection pipelines, the pump enables operations such as venting, emptying, and blowdown.

In some embodiments, by optimizing the force-bearing assembly, the piston forced return assembly, the piston cylinder, and the swash plate of the axial piston pump, it enables the pump to withstand substantial axial forces. Under the axial forces, the pump maintains operational integrity without failure, which can enhance resistance to vibration, oscillation, and impact, and allow reliable operation in adverse conditions characterized by significant sway or shock. Through design of heat dissipation channels, convection channels, hydrodynamic lubrication, and hydrostatic lubrication, cavitation structures are minimized, noise is reduced, and product service life is extended. The incorporation of additional hydrostatic, hydrodynamic, and damping design elements further enhances product longevity and reliability.

Merely by way of example, a working principle of the piston pump is as follows:

Upon activation of an external power source such as an electric motor or internal combustion engine, the transmission shaft 8 rotates and drives the piston cylinder 2.2 to rotate. The piston cylinder 2.2 drives the ceramic piston 4.1 and the ceramic slipper 4.6 to rotate along the inclined friction plate 5.2 of the swash plate assembly 5. During rotation, the ceramic piston 4.1 reciprocates within the piston sleeve 2.4, causing volume changes within the piston sleeve 2.4 to achieve suction of low-pressure water and discharge of high-pressure water. Low-pressure water enters through the water inlet 7.4 on the inlet and outlet flange 7, passes through the port plate orifices 1.4.3 of the port plate assembly 1.4 and the valve holes 1.3.3 of the thrust plate assembly 1.3, and enters the piston sleeve 2.4 of the piston cylinder 2.2. As the ceramic piston 4.1 extrudes, the low-pressure water is pressurized into high-pressure water, which then passes through the valve holes 1.3.3 of the thrust plate assembly 1.3 and the port plate orifices 1.4.3 of the port plate assembly 1.4 and is discharged from the water outlet 7.5 of the inlet and outlet flange 7.

The port plate assembly 1.4 is configured to allocate flow to the piston sleeve 2.4 with volume changes during the rotation of the piston cylinder 2.2. The thrust plate assembly 1.3 primarily seals the thrust plate and the port plate assembly 1.4. For the thrust plate assembly, under action of a spring of the pre-sealing thrust mechanism 1.2, the outer cylindrical surface of the thrust plate ceramic wear ring 1.3.2 is in close contact with the inner cylindrical surface of the thrust plate support ring 1.3.1, so as to form an axial sealing pair to prevent leakage of high-pressure water. Simultaneously, a floating design of the thrust plate enables adaptive position adjustment to compensate for unbalanced forces caused by machining and assembly errors, ensuring uniform fitting of sealing surfaces and reducing wear.

In some embodiments, the axial piston pump further includes a plurality of temperature sensors, a plurality of micro-vibration accelerometers, a plurality of pressure sensors, and flow sensors, which are configured respectively to acquire temperature data, vibration data, pressure data, and flow velocity data.

The plurality of temperature sensors, the plurality of micro-vibration accelerometers, and the plurality of pressure sensors may be respectively arranged at corresponding locations on various components such as the flow distribution and distribution sealing axial thrust bearing 1, the end axial bearing 9, or the port plate assembly 1.4. The flow sensors may be arranged at corresponding locations on a plurality of components such as the hydrostatic bearing high-pressure water supply port 7.1, the water inlet 7.4, or the water outlet 7.5.

A plurality of temperature sensors, a plurality of micro-vibration accelerometers, and a plurality of pressure sensors are configured to acquire a temperature data sequence at a plurality of locations (hereinafter referred to as temperature data), a vibration data sequence at a plurality of locations (hereinafter referred to as vibration data), and a pressure data sequence at a plurality of locations (hereinafter referred to as pressure data), respectively. The temperature sensors include thermistors, thermocouples, or similar devices. The micro-vibration accelerometers include piezoelectric accelerometers. The pressure sensors include piezoresistive, piezoelectric, strain gauge sensors, or the like. The flow sensors include turbine flow meters, electromagnetic flow meters, ultrasonic flow meters, or the like.

In some embodiments, the piston pump further includes a water supply assembly. The water supply assembly includes a variable pump, a first water supply pipe and a second water supply pipe. The hydrostatic bearing high-pressure water supply port 7.1 is connected to the variable pump via the first water supply pipe, while the water inlet 7.4 is connected to the variable pump via the second water supply pipe. A first solenoid valve and a second solenoid valve are installed in the first water supply pipe or the second water supply pipe, respectively.

The water supply assembly provides water to the hydrostatic bearing high-pressure water supply port 7.1 and the water inlet 7.4. The variable pump refers to a pump capable of adjusting output flow rate or pressure. The variable pump includes a variable frequency pump or a variable displacement pump. A count of the variable pump may be two, with two variable pumps being connected to the first water supply pipe and the second water supply pipe, respectively.

In some embodiments, the axial piston pump further includes a processor. The processor may be in communication with a plurality of components of the axial piston pump. The processor may refer to a Central Processing Unit (CPU), an Application Specific Integrated Circuit (ASIC), or the like. For example, the processor may be in communication with the plurality of temperature sensors, the plurality of micro-vibration accelerometers, the plurality of pressure sensors, the flow sensors, the variable pump, the plurality of solenoid valves, or the like.

In some embodiments, the processor is configured to: determine a target pressure sequence, wherein the target pressure sequence includes target pressures at a plurality of key locations; determine pressure difference sequences at a plurality of time points based on a preset frequency, wherein the pressure difference sequence at each time point is a difference sequence between the actual pressures at the a plurality of key locations at the time point and the corresponding target pressures; determine whether to perform pressure adjustment based on the pressure difference sequences at a plurality of time points within a preset time period; and in response to performing pressure adjustment, adjust an first solenoid valve opening, an second solenoid valve opening, and/or an operating power of the variable pump based on the target pressure sequence, the pressure difference sequences at a plurality of time points, and the actual pressure sequence at the current time.

The key position refers to a point within the piston pump where pressure requires focused monitoring and control. For example, the key location includes the hydrostatic bearing high-pressure water supply port and the water inlet, with corresponding target pressures being P1 for the hydrostatic bearing high-pressure water supply port and P2 for the water inlet. Thus, the target pressure sequence is [P1, P2].

The preset frequency refers to a fixed time interval for data sampling or processing. For example, the preset frequency may be 100 times per second.

The pressure difference sequence at a time is a sequence formed by differences between the actual pressures at a plurality of key locations and corresponding target pressures at the time. For example, if the actual pressures at the hydrostatic bearing high-pressure water supply port and the water inlet are P11 and P21 respectively at the time, the pressure difference sequence at the time is [P1-P11, P2-P21]. The actual pressure at the time and the actual pressure sequence at the current time may be obtained via the pressure sensors.

The preset time period refers to a time window used for judgment, such as a past 5 minutes.

The actual pressure sequence refers to a set of pressure values actually measured at a plurality of key locations at a current time or over a past period. The operating power of a variable pump may be adjusted by adjusting a frequency of a variable-frequency pump or a motor rotation speed within a variable-displacement pump. A solenoid valve opening refers to a degree to which a valve is opened.

In some embodiments, the processor determines that pressure adjustment is required when a sum of absolute values in the pressure difference sequences at all times exceeds a preset difference threshold.

In some embodiments, in response to performing the pressure adjustment, the processor determines the first solenoid valve opening, the second solenoid valve opening, and/or the operating power of the variable pump based on the target pressure sequence, the pressure difference sequences at a plurality of times, and the actual pressure sequence at the current time via a first preset table. The first preset table includes the target pressure sequence, the pressure difference sequences at a plurality of time points, the actual pressure sequence at the current time, and the corresponding first solenoid valve opening, the corresponding second solenoid valve opening, and/or the corresponding operating power of the variable pump. The first preset table may be constructed by technicians based on experimental data.

After determining the first solenoid valve opening and the second solenoid valve opening, and/or the operating power of the variable pump, the processor may control the first solenoid valve based on the first solenoid valve opening, the second solenoid valve based on the second solenoid valve opening, and the variable pump based on the operating power of the variable pump to operate by a control algorithm, such as a proportional-integral-derivative (PID) control.

In some embodiments, the processor is configured to determine an estimated overall pressure for the pressure difference sequence at each time point within a preset time period. The processor is configured to determine a first count of time points when the estimated overall pressure exceeds a first pressure threshold.

In response to the first count of time points exceeding a first quantity threshold, the processor controls the water supply assembly to perform a first type of pressure adjustment, the first type of pressure adjustment involves adjusting the operating power of the variable pump, the first solenoid valve opening, and the second solenoid valve opening.

In response to the first count of time points not exceeding the first quantity threshold, the second count of time points when the estimated overall pressure does not exceed the first pressure threshold but exceeds the second pressure threshold is determinized. In response to the second count of time points exceeding the second quantity threshold, the processor performs the second type of pressure adjustment. The second type of pressure adjustment involves adjusting the first solenoid valve opening and the second solenoid valve opening.

The estimated overall pressure refers to a value obtained after processing the pressure difference sequence. The estimated overall pressure characterizes a degree of pressure deviation in the axial piston pump.

For example, the estimated overall pressure may include values generated by weighting and summing a plurality of differences within the pressure difference sequence. In some embodiments, the processor may preset different weighting coefficients for different key locations, thereby determining the weighting coefficients of the key locations corresponding to the plurality of differences.

In response to a determination that the estimated overall pressure exceeds the first pressure threshold, it indicates a pressure deviation issue in the piston pump.

The first count of time points refers a count of sampling time points when the estimated overall pressure exceeds the first pressure threshold. The first count of time points may be statistically determined by the processor.

The first quantity threshold is a preset limit for a count of time points. In response to a determination that the first count of time points exceeds the first quantity threshold, it indicates a significant deviation in pressure of the piston pump.

The second pressure threshold may be a smaller pressure deviation limit, falling between 0 and the first pressure threshold. If the pressure of the axial piston pump exceeds the second pressure threshold but does not exceed the first pressure threshold, it indicates a moderate pressure deviation issue in the axial piston pump.

The second count of time points refers to a count of sampling time points when the estimated overall pressure exceeds the second pressure threshold but does not exceed the first pressure threshold. Determination manners for the second count of time points are similar to that for the first count of time points and are not repeated here.

The second quantity threshold is configured to determine whether to perform the second type of pressure adjustment.

In some embodiments, based on quantified results of the estimated overall pressure, it is possible to effectively distinguish between severe large deviations and moderate small deviations, avoiding excessive intervention and enhancing accuracy and stability of axial piston pump adjustment.

In some embodiments, the processor is configured to generate a plurality of candidate parameter sequences, each candidate parameter sequence including a candidate operating power of the variable pump, a candidate first solenoid valve opening, and a candidate second solenoid valve opening. For each candidate parameter sequence, the processor predicts a predicted pressure sequence at a plurality of key locations corresponding to the candidate parameter sequence by using a first machine learning model. Based on the predicted pressure sequences at a plurality of the key locations, the processor determines the target parameter sequence.

The candidate parameter sequence refers to a pre-generated combination of control parameters for the axial piston pump to be tested. The candidate parameter sequence may be preset by the processor.

In some embodiments, a third solenoid valve and a fourth solenoid valve are respectively provided at the convection groove 7.2 and the flange convection pipeline interface 7.6. The candidate parameter sequence further includes the third solenoid valve opening and the fourth solenoid valve opening.

In some embodiments, adding the third solenoid valve and the fourth solenoid valve and incorporating the third solenoid valve and the fourth solenoid valve into the candidate parameter sequence can enhances precision and robustness of pressure adjustment.

A predicted pressure sequence is a set of predicted pressure data for the axial piston pump at future time points. The predicted pressure sequence may be generated by the first machine learning model.

The first machine learning model is a machine learning model configured to predict the estimated pressure sequence. For example, the first machine learning model may be a Support Vector Machine (SVM), a Neural Network (NN), etc.

Input to the first machine learning model includes the candidate parameter sequences, the target pressure sequence, the pressure difference sequences at a plurality of time points, and the actual pressure sequence at the current time point. An output of the first machine learning model includes the predicted pressure sequences corresponding to the candidate parameter sequences.

In some embodiments, the first machine learning model may be obtained through model training. The processor may obtain the first machine learning model through the model training based on a plurality of sets of first training samples with first training labels. A first training sample includes a sample candidate parameter sequence, a sample target pressure sequence, a sample pressure difference sequence at a plurality of time points, and a sample actual pressure sequence at a current time point.

The first training sample may be obtained from historical monitoring data, and a first training label may be the actual pressure sequence corresponding to the first training sample. The first training label may be annotated by a processor and/or manually based on historical monitoring data.

In some embodiments, the input to the first machine learning model further includes a physical structural diagram of the axial piston pump. The physical structure diagram of the axial piston pump may be determined from design drawings of the axial piston pump. Correspondingly, the first training sample also includes a sample physical structural diagram.

The input to the first machine learning model also includes a first type parameter, a second type parameter, and a third type parameter. The first type parameter includes relevant parameters of the piston cylinder assembly 2 and inlet and outlet flange 7. For example, the first type parameter includes dimensions of the piston cylinder assembly 2, dimensions of its internal cavity, dimensions of the inlet and outlet flange 7, and a clearance between components of the piston cylinder assembly 2. The second type parameter includes relevant parameters of the piston and the piston forced return assembly 4. For example, the second type parameter includes a piston diameter, a combined structural form of the ceramic piston 4.1 and the ceramic slipper 4.6, a contact area of a friction surface in a plane friction pair, and a preload value of the preload spring 4.5. The third type parameter includes relevant parameters of the swash plate assembly 5. For example, the third type parameter includes a tilt angle and a coaxiality of the swash plate 5.1. Correspondingly, the first training sample also includes a sample first type parameter, a sample second type parameter, and a sample type parameter.

In some embodiments, by inputting the physical structural diagram of the axial piston pump into the first machine learning model, the first machine learning model can gain an understanding of spatial and geometric context of the data, so as to enhance predictive accuracy of the first machine learning model and generalization capability regarding system pressure changes.

In some embodiments, by inputting relevant parameters of core components of the axial piston pump into the first machine learning model, the model can precisely establish the correlation between parameters and pressure changes, thereby improving prediction and control accuracy and efficiency.

During the model training, the first training samples are input into an initial first model. A loss function is constructed based on outputs of the initial first model and the first training labels. Parameters of the initial first model are iteratively updated based on the loss function until the predefined training conditions are met, the training ends and the first machine learning model is obtained. The preset training conditions may include, but are not limited to, convergence of the loss function or the training cycle reaching a threshold. Iterative update manners include gradient descent or simulated annealing algorithms.

The target parameter sequence refers to a final determined optimal parameter sequence configured to execute pressure regulation for the axial piston pump.

A structure of the target parameter sequence is identical to that of the candidate parameter sequence and is not repeated here.

In some embodiments, the processor may determine a pressure difference sequence based on the predicted pressure sequence and the target pressure sequence, thereby generating an estimated overall pressure. The processor selects the candidate parameter sequence with the smallest estimated overall pressure as the target parameter sequence, from all candidate parameter sequences with predicted integrated pressure less than or equal to the second pressure threshold. The processor sends the target parameter sequence to the solenoid valve and the variable pump for actual adjustment.

In some embodiments, in response to the predicted overall pressures all being greater than the second pressure threshold, a plurality of candidate parameter sequences are regenerated until a candidate parameter sequence occurs in which the predicted overall pressure is less than the second pressure threshold.

In some embodiments, the processor predicts estimated pressure by using a first machine learning model, enabling rapid assessment of how different combinations of control parameters affect pressure at future time points. The processor allows efficient determination and implementation of the target parameter sequence, thus significantly enhancing efficiency and accuracy of pressure control.

In some embodiments, the processor may acquire monitoring data. Based on the monitoring data, the processor uses a second machine learning model to predict abnormal information and issue an early warning based on the abnormal information.

The monitoring data refers to a set of parameters reflecting an operational status of the axial piston pump. The monitoring data includes temperature data, pressure data, vibration data, flow rate data, etc. The processor may collect monitoring data based on a plurality of sensors (e.g., temperature sensors) set up within the axial piston pump.

The abnormal information refers to information reflecting faults or issues of the axial piston pump. The abnormal information includes an abnormal type and a corresponding abnormal probability. The abnormal probability indicates likelihood of the abnormal type occurring.

For example, the abnormal type may include excessive axial force, abnormal vibration, overheating, component wear, etc.

The second machine learning model is a machine learning model configured to predict the abnormal information.

For example, the second machine learning model may be a Recurrent Neural Network (RNN).

In some embodiments, an input to the second machine learning model includes the monitoring data, and an output of the second machine learning model includes the abnormal information.

In some embodiments, the second machine learning model may be obtained through model training.

The processor may obtain the second machine learning model through the model training based on a plurality of sets of second training samples with second training labels.

The second training sample includes sample monitoring data, and the second training label may include the abnormal information.

In some embodiments, the input to the second machine learning model may also include a clearance of the port plate assembly 1.4, a clearance between the ceramic piston 4.1 and the piston cylinder assembly 2, a contact area between the inlet and outlet flange 7 and the piston cylinder assembly 2, and/or the flow channel curvature. The clearance, the contact area, and/or the flow channel curvature may be preset by a technician. Correspondingly, the second training sample further includes a sample distributor clearance, a sample piston guide clearance, a sample friction pair contact area, and/or a sample flow channel curvature. In some embodiments, the input to the second machine learning model may further include opening degrees of one or more solenoid valves and/or the operating power of the variable pump. Correspondingly, the second training sample also includes a sample opening of one or more solenoid valves and/or a sample operating power of the variable pump.

In some embodiments, incorporating inputs such as the clearance or the contact area of the axial piston pump into the second machine learning model can enhance accuracy of abnormal prediction and reliability of fault type identification.

The second training sample may be obtained from historical monitoring data, and the second training label may correspond to actual abnormal data associated with the second training sample. The second training labels may be annotated by the processor and/or manually based on the historical monitoring data.

Training processes for the second machine learning model are similar to that of the first machine learning model and are not repeated here.

In some embodiments, the first machine learning model and the second machine learning model may be obtained through joint training.

For example, during the joint training, the first training sample is input into the initial first model. The output from the initial first model is treated as one piece of data within the second training sample and input into an initial second model along with other data. The processor may construct a loss function using an output of the initial second model and the second training label. The parameters of both the initial first model and the initial second model are iteratively updated based on the loss function. The joint training ends when predefined training conditions are met, and the first machine learning model and the second machine learning model are obtained. For more descriptions about the preset training conditions, refer to the training processes of the first machine learning model, which is not repeated here.

In some embodiments, by incorporating control parameters such as solenoid valve opening as inputs to the second machine learning model and employing joint training, the second machine learning model can correlate operational status data with current control actions, thereby enhancing precision of abnormal prediction.

In some embodiments, the processor may preset a probability threshold. When an abnormal probability of an abnormal type exceeds a preset probability threshold (e.g., an abnormal probability with excessive axial force is greater than 70%), the processor immediately generates an early warning command and issues an alarm or triggers an automated safety shutdown procedure.

In some embodiments, the processor may determine a risk level based on the abnormal type and corresponding abnormal probability, determine an alert level based on the risk level and a plurality of safety thresholds, and issue alerts based on the alert level.

The risk level is a quantitative assessment value representing severity of abnormal situations. The risk level characterizes potential impact of the abnormal type and the abnormal probability.

In some embodiments, the processor may set different base hazard scores for different abnormal types. For example, a base hazard score for excessive axial force is higher than that for an excessive temperature.

For each abnormal type, the processor may multiply the abnormal probability associated with the abnormal type by corresponding base hazard score to generate a hazard score. The hazard scores for different abnormal types are then summed to determine the hazard level.

The safety threshold is a critical value configured to determine whether an axial piston pump is in a safe state. The safety threshold may be preset for different abnormal types and operating conditions. The safety threshold may be preset by the processor.

In some embodiments, the safety threshold may be determined based on operating environment parameters of the axial piston pump.

The operating environment parameters refer to external environmental conditions surrounding the axial piston pump. The operating environment parameters may include ambient temperatures, humidity, altitude, etc. The operating environment parameters may be captured by environmental sensors (e.g., temperature and humidity sensors, etc.) set up on the piston pump.

In some embodiments, the processor may dynamically adjust the safety threshold based on current ambient temperatures and humidity. In some embodiments, the processor may determine a plurality of safety thresholds by querying a second preset table. The second preset table includes a large count of environmental temperature and humidity along with corresponding safety thresholds for different abnormal types. The second preset table is preset by the processor.

By setting dynamic safety thresholds, it enables more precise early warnings, avoiding false alarms or missed detections caused by environmental factors, thereby enhancing accuracy and reliability of alerts.

The warning level may be categorized into a plurality of levels (e.g., slight, moderate, severe, emergency, etc.), and different warning levels correspond to different response measures.

In some embodiments, the processor may compare a currently calculated hazard level against a plurality of safety thresholds to determine the warning level.

For example, when a minor abnormal exists, a prompt such as "Recommend periodic inspection" may be displayed on the interactive interface, when a moderate abnormal exists, an orange alert stating "Recommended immediate inspection!" may appear on the interactive interface. When a severe abnormal exists, a red emergency alert may be displayed on the interactive interface while simultaneously activating audible/visual alarms and sending mandatory notifications.

In some embodiments, by weighting abnormal types and abnormal probabilities to quantify risk levels and determining alert levels based on safety thresholds, differentiated responses to alerts can be achieved, avoiding excessive intervention.

Foregoing descriptions has outlined fundamental concepts. It is evident to those skilled in the art that the present disclosure above serves merely as an example and does not constitute a limitation on the present disclosure. Although not explicitly stated herein, those skilled in the art may make various modifications, improvements, and corrections to the present disclosure. Such modifications, improvements, and corrections are suggested herein and thus remain within spirits and scopes of the exemplary embodiments described in the present disclosure.

What is claimed is:

1. An axial piston pump, comprising a pump housing assembly, a base plate, and an inlet and outlet flange, wherein the base plate is located at a bottom of the pump housing assembly, the inlet and outlet flange is located at a top of the pump housing assembly, the pump housing assembly, the base plate, and the inlet and outlet flange enclose an inner chamber configured to accommodate other structures of the axial piston pump including a piston cylinder assembly, a piston and piston forced return assembly, and a swash plate assembly, and a transmission shaft passes through the inlet and outlet flange and is connected to the piston cylinder assembly, wherein the piston and piston forced return assembly includes a piston assembly and a forced return mechanism, the piston assembly includes a ceramic piston and a ceramic slipper combined together, and the forced return mechanism includes a return plate, a spherical hinge, a return guide column, and preload springs; the ceramic slipper is connected to the return plate and is supported on a swash surface of the swash plate assembly; a plane of the spherical hinge and the return plate form a plane friction pair, and a spherical surface of the spherical hinge is hinged to a spherical socket of the return guide column; the return guide column is installed in a return guide sleeve of the piston cylinder assembly, a side of the return guide column opposite to the spherical socket is provided with a plurality of spring holes for installing the preload springs, and ends of the preload springs protrude from the spring holes and abut against the piston cylinder assembly;

the piston cylinder assembly includes a piston cylinder and a hydrostatic inner ring disposed on an outer side of the piston cylinder, the ceramic piston of the piston assembly is movably disposed in a piston sleeve of the piston cylinder, one end of the piston cylinder is drivingly connected to the transmission shaft, and a center hole at another end of the piston cylinder is provided with the return guide sleeve, and the return guide sleeve cooperates with the return guide column in the forced return mechanism to provide cooperative guiding;

the pump housing assembly includes a pump housing on an outer side and a hydrostatic outer ring on an inner side, and the hydrostatic outer ring and the hydrostatic inner ring are both made of a ceramic material and form a hydrostatic main bearing; the hydrostatic outer ring is supported on a support surface at an end of the hydrostatic inner ring, an outer cylindrical surface of the hydrostatic inner ring is provided with a hydrostatic pad, an outer cylindrical surface of the hydrostatic outer ring is provided with a high-pressure water annular groove, and the high-pressure water annular groove communicates with the hydrostatic pad through a hydrostatic main bearing pressure supply hole provided in the high-pressure water annular groove; and one end of the hydrostatic outer ring is provided with a hydrodynamic support friction surface, which frictionally contacts the support surface, and the hydrodynamic support friction surface is provided with a plurality of first Archimedean spiral convection grooves along a circumferential direction of the hydrodynamic support friction surface;

the hydrostatic pad of the hydrostatic inner ring has a wedge-shaped stepped structure, including a first hydrostatic water pad and two second hydrostatic water pads, one second hydrostatic water pad is disposed at each axial end of the first hydrostatic water pad, and the first hydrostatic water pad is lower than the two second hydrostatic water pads, forming a stepped structure; and the two second hydrostatic water pads each have a wedge-shaped structure, and a small diameter end of each of the two second hydrostatic water pads is connected to the first hydrostatic water pad;

the spherical socket of the return guide column is provided with a central through hole and an Archimedean spiral damping groove is arranged surrounding the central through hole; a bottom surface of the spherical hinge is provided with a convection damping hole penetrating through the spherical surface of the spherical hinge, the convection damping hole communicates with the central through hole, and a labyrinth hydrostatic support water pad is disposed surrounding the convection damping hole;

the piston assembly includes the ceramic piston and the ceramic slipper, a ball head of the ceramic piston is provided with a center hole and a ball head damping groove surrounding the center hole, and the ball head damping groove is an Archimedean spiral groove; and a center of an end surface of the ceramic slipper is provided with a slipper damping hole capable of communicating with the center hole, and a third hydrostatic water pad having a sealing band is disposed surrounding the slipper damping hole;

two ends of the hydrostatic main bearing are respectively provided with a flow distribution and distribution sealing axial thrust bearing and an end axial bearing, wherein the flow distribution and distribution sealing axial thrust bearing is adjacent to the inlet and outlet flange, and the end axial bearing is located at a bottom of the axial piston pump and is disposed surrounding the swash plate assembly;

the flow distribution and distribution sealing axial thrust bearing includes a thrust plate guiding assembly, a thrust plate assembly, and a port plate assembly coaxially arranged in sequence; the thrust plate guiding assembly, the thrust plate assembly, and the port plate assembly all have annular disk-shaped structures, an outer side of a center hole of the thrust plate guiding assembly is coaxially provided with a pre-sealing thrust mechanism, the pre-sealing thrust mechanism is connected to an end surface of the piston cylinder of the piston cylinder assembly, and a guide member on the thrust plate guiding assembly is sealingly connected to the piston sleeve of the piston cylinder; and the flow distribution and distribution sealing axial thrust bearing is provided with a medium channel communicating with the piston sleeve;

the end axial bearing is cylindrical, including a polyether-ether-ketone (PEEK) collar and an alloy core embedded in the PEEK collar, an end surface of the PEEK collar facing the hydrostatic main bearing is provided with a composite surface, the composite surface contacts an inner ring friction surface of the hydrostatic inner ring, the composite surface includes a wedge-shaped surface, a bearing support surface, and a second Archimedean spiral convection groove connected in sequence, an angle of the wedge-shaped surface ranges from 1° to 2°, and a plurality of the composite surfaces are sequentially arranged along a circumferential direction on an end surface of the end axial bearing;

the pre-sealing thrust mechanism includes a thrust retaining ring and a plurality of thrust springs installed on a same side of the thrust retaining ring, the plurality of thrust springs are arranged at intervals along a circumferential direction of the thrust retaining ring, the thrust retaining ring is installed in an annular groove on an end surface of the piston cylinder assembly, and the annular groove is provided with thrust spring guide holes for accommodating the thrust springs;

the thrust plate assembly includes a thrust plate support ring and a thrust plate ceramic wear ring connected coaxially, an outer cylindrical surface of the thrust plate ceramic wear ring is assembled on an inner cylindrical surface of the thrust plate support ring, and the thrust plate support ring is a metal ring; and the thrust plate ceramic wear ring is provided with a plurality of valve holes at intervals along a circumferential direction;

the port plate assembly includes a port plate support ring and a port plate ceramic wear ring connected coaxially, the port plate support ring is a metal ring, an outer cylindrical surface of the port plate ceramic wear ring is assembled on an inner cylindrical surface of the port plate support ring, and the port plate ceramic wear ring is provided with a plurality of port plate orifices at intervals along a circumferential direction; and through holes on the thrust plate guiding assembly, the port plate orifices on the port plate assembly, and the valve holes on the thrust plate assembly communicate to form the medium channel.

2. The axial piston pump of claim 1, wherein the swash plate assembly includes a swash plate made of a metal material and a friction plate fixed on a swash surface of the swash plate, and the friction plate includes a ceramic inner ring and a metal outer ring connected by interference fit.

3. The axial piston pump of claim 1, wherein the inlet and outlet flange is entirely made of a ceramic material, and the inlet and outlet flange is provided with a hydrostatic bearing high-pressure water supply port, a convection groove, an inlet port, and an outlet port; the hydrostatic bearing high-pressure water supply port is used to supply high-pressure water to the hydrostatic main bearing; and the inlet port and the outlet port are both disposed surrounding a flange hole at a center of the inlet and outlet flange, and are used for water inlet and water outlet of the axial piston pump.

4. The axial piston pump of claim 1, wherein the axial piston pump further comprises a plurality of temperature sensors, a plurality of micro-vibration accelerometers, a plurality of pressure sensors, and a flow sensor, which are configured to acquire temperature data, vibration data, pressure data, and flow rate data, respectively.

5. The axial piston pump of claim 1, wherein the axial piston pump further comprises a water supply assembly; the water supply assembly comprises a variable pump, a first water supply pipe and a second water supply pipe; the hydrostatic bearing high-pressure water supply port communicates with the variable pump through the first water supply pipe, and the inlet port communicates with the variable pump through the second water supply pipe; and a first solenoid valve and a second solenoid valve are respectively installed in the first water supply pipe and the second water supply pipe.

6. The axial piston pump of claim 5, wherein the axial piston pump further comprises a processor; and the processor is configured to:

determine a target pressure sequence, wherein the target pressure sequence includes target pressures at a plurality of key positions;

determine pressure difference sequences at a plurality of time points based on a preset frequency; wherein a pressure difference sequence at each time point is a difference sequence between actual pressures at the plurality of key positions at the time point and corresponding target pressures;

determine whether to perform pressure adjustment based on the pressure difference sequences at the plurality of time points within a preset period; and in response to determining that the pressure adjustment is performed, adjust at least one of a first solenoid valve opening, a second solenoid valve opening, and an operating power of the variable pump based on the target pressure sequence, the pressure difference sequences at the plurality of time points, and an actual pressure sequence at a current time.

7. The axial piston pump of claim 6, wherein the processor is further configured to:

for the pressure difference sequence at each time point within the preset period, determine a predicted overall pressure at the time point;

determine a first count of time points when the predicted overall pressure exceeds a first pressure threshold, in response to the first count of time points exceeding a first quantity threshold, control the water supply assembly to perform a first type of pressure adjustment, wherein the first type of pressure adjustment is adjusting the operating power of the variable pump, the first solenoid valve opening, and the second solenoid valve opening; and in response to the first count of time points not exceeding the first quantity threshold, determine a second count of time points when the predicted overall pressure does not exceed the first pressure threshold but exceeds a second pressure threshold; in response to the second count of time points exceeding a second quantity threshold, perform a second type of pressure adjustment, wherein the second type of pressure adjustment is adjusting the first solenoid valve opening and the second solenoid valve opening.

8. The axial piston pump of claim 7, wherein the processor is further configured to:

generate a plurality of candidate parameter sequences, wherein each of the plurality of candidate parameter sequences includes a candidate operating power, a candidate first solenoid valve opening, and a candidate second solenoid valve opening;

for each of the plurality of candidate parameter sequences, predict a predicted pressure sequence at the plurality of key positions corresponding to the candidate parameter sequence via a first machine learning model; and determine a target parameter sequence based on the predicted pressure sequences at the plurality of key positions.

9. The axial piston pump of claim 8, wherein a third solenoid valve and a fourth solenoid valve are respectively disposed at the convection groove and the flange convection pipeline interface; and each of the plurality of candidate parameter sequences further includes a third solenoid valve opening and a fourth solenoid valve opening.

10. The axial piston pump of claim 8, wherein an input of the first machine learning model further includes: a physical structural diagram of the axial piston pump.

11. The axial piston pump of claim 8, wherein an input of the first machine learning model further includes:

a first type parameter, wherein the first type parameter is a relevant parameter of the piston cylinder assembly and the inlet and outlet flange;

a second type parameter, wherein the second type parameter is a relevant parameter of the piston and piston forced return assembly; and a third type parameter, wherein the third type parameter is a relevant parameter of the swash plate assembly.

12. The axial piston pump of claim 6, wherein the processor is further configured to:

acquire monitoring data, wherein the monitoring data includes temperature data, pressure data, vibration data, and flow rate data; and predict abnormal information based on the monitoring data via a second machine learning model, wherein the abnormal information includes an abnormal type and a corresponding abnormal probability; and perform an early warning based on the abnormal information.

13. The axial piston pump of claim 12, wherein an input of the second machine learning model further includes: a port plate clearance, a piston guide clearance, a friction pair contact area, and a flow channel curvature.

14. The axial piston pump of claim 12, wherein an input of the second machine learning model further includes: at least one of the first solenoid valve opening, the second solenoid valve opening, a third solenoid valve opening, a fourth solenoid valve opening, and the operating power of the variable pump; and the first machine learning model and the second machine learning model are determined through joint training.

15. The axial piston pump of claim 12, wherein to perform the early warning based on the abnormal data, the processor is further configured to:

determine a risk level based on the abnormal type and the corresponding abnormal probability; and determine a warning level based on the risk level and a plurality of safety thresholds and perform the early warning based on the warning level.

* * * * *